US007735978B2

(12) United States Patent
Chikamoto

(10) Patent No.: US 7,735,978 B2
(45) Date of Patent: Jun. 15, 2010

(54) INKJET HEAD AND PROCESS OF MANUFACTURING THE INKJET HEAD

(75) Inventor: Tadanobu Chikamoto, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 850 days.

(21) Appl. No.: 11/275,287

(22) Filed: Dec. 21, 2005

(65) Prior Publication Data

US 2006/0132551 A1 Jun. 22, 2006

(30) Foreign Application Priority Data

Dec. 22, 2004 (JP) ..... 2004-370339

(51) Int. Cl.
*B41J 2/045* (2006.01)

(52) U.S. Cl. ..... 347/71; 347/72

(58) Field of Classification Search ..... 347/71, 347/72, 70, 65

See application file for complete search history.

(56) References Cited

U.S. PATENT DOCUMENTS

| | | | | |
|---|---|---|---|---|
| 5,872,583 | A * | 2/1999 | Yamamoto et al. | 347/70 |
| 5,963,234 | A | 10/1999 | Miyazawa et al. | |
| 6,361,155 | B1 * | 3/2002 | Kanda et al. | 347/70 |
| 2002/0196315 | A1 * | 12/2002 | Isono et al. | 347/71 |
| 2004/0183867 | A1 | 9/2004 | Hirota | |

FOREIGN PATENT DOCUMENTS

| | | | |
|---|---|---|---|
| JP | 1997150503 A | | 6/1997 |
| JP | 1997314836 A | | 12/1997 |
| JP | 2002-105410 A | | 4/2002 |
| JP | 2002105410 A | * | 4/2002 |
| JP | 2003062991 A | | 3/2003 |
| JP | 2004276562 A | | 10/2004 |

OTHER PUBLICATIONS

Japanese Patent Office, Notification of Reason for Refusal in Japanese Patent Application No. 2004-039500 (counterpart of above-captioned U.S. patent application) mailed Dec. 9, 2008 (partial translation).

* cited by examiner

*Primary Examiner*—Matthew Luu
*Assistant Examiner*—Lisa M Solomon
(74) *Attorney, Agent, or Firm*—Baker Botts L.L.P.

(57) ABSTRACT

An inkjet head including an ink channel unit defining a network of ink channels which provides at least one common ink chamber and a plurality of nozzles held in communication with the at least one common ink chamber. The ink channel unit includes a laminated structure body that is provided by a plurality of metal plates superposed on each other. The laminated structure body has at least the at least one common ink chamber and an atmosphere communication channel which diverges from the network of ink channels. The atmosphere communication channel extends toward an exterior of the laminated structure body, so as to open outside the laminated structure body. The atmosphere communication channel is sealed at its opening. Also disclosed is a process of manufacturing the inkjet head.

15 Claims, 16 Drawing Sheets

INKJET HEAD AND PROCESS OF MANUFACTURING THE INKJET HEAD

This application is based on Japanese Patent Application No. 2004-370339 filed in Dec. 22, 2004, the content of which is incorporated hereinto by reference.

BACKGROUND OF THE INVENTION

1. Field of the Invention

The present invention relates to an inkjet head operable to eject an ink onto a recording medium, and a process of manufacturing the inkjet head.

2. Discussion of Related Art

Conventionally, there is known, as an inkjet head operable to eject an ink, an inkjet head including an ink channel unit which defines a network of ink channels and which includes a laminated structure body provided by a plurality of plates superposed on each other. US 2004/0183867 A1 (corresponding to JP-2004-276562A) discloses such an inkjet head including an ink channel unit defining a manifold chamber, a plurality of individual ink channels and a plurality of nozzles which are held in communication with the manifold chamber via the respective individual ink channels. This ink channel unit consists of a laminated structure body provided by a plurality of metal plates that are superposed on each other. The superposed metal plates may be fixed to each other by suitable means such as adhesive and diffusion welding.

Where the plurality of metal plates providing the laminated structure body are fixed to each other by diffusion welding, the metal plates are heated at a high temperature (about 1000° C.) under a vacuum condition while being gripped by a pair of jig members having respective flat contact surfaces such that the flat contact surfaces are respectively held in contact with opposite end ones of the superposed metal plates, so that the metal plates are fixed at their mutually contacted surfaces to each other, by causing diffusion of metallic atoms between the mutually contacted surfaces. This diffusion welding enables the plurality of metal plates to be fixed to each other in a single step, thereby making it possible to simplify the manufacturing process.

In a process of the diffusion welding, when the laminated structure body is gripped by the pair of jig members, a gas (e.g., air) is shut up in cavities such as the manifold chambers and pressure chambers that are formed in the laminated structure body, since the cavities are tightly closed by the pair of jig members. If the laminated structure body is heated at the high temperature to carry out the diffusion welding and is then cooled, the gas shut up in the cavities is caused to expand and contract, leading to considerable fluctuation of a pressure of the gas in the cavities and accordingly causing a risk of partial deformation of the laminated structure body. Further, increase of the pressure of the gas in the cavities would cause failure of fixation of the metal plates in vicinity of the cavities, thereby causing a risk of leakage of an ink from the ink channels.

SUMMARY OF THE INVENTION

It is therefore a first object of the invention to provide an inkjet head having a construction permitting a gas to be reliably evacuated from the ink channels that are defined in the laminated structure body, when the metal plates are fixed to each other in a process of manufacturing the inkjet head. It is a second object of the invention to provide a process of manufacturing the inkjet head. The first object may be achieved according to any one of first through fourth aspects of the invention that are described below. The second object may be achieved according to a fifth aspect of the invention that is described below.

The first aspect of the invention provides an inkjet head including an ink channel unit defining a network of ink channels which provides at least one common ink chamber and a plurality of nozzles held in communication with the at least one common ink chamber, wherein the ink channel unit includes a laminated structure body that is provided by a plurality of metal plates superposed on each other, wherein the laminated structure body has at least the at least one common ink chamber and an atmosphere communication channel which diverges from the network of ink channels, wherein the atmosphere communication channel extends toward an exterior of the laminated structure body, so as to open outside the laminated structure body, and wherein the atmosphere communication channel is sealed at an opening thereof.

Where the plurality of metal plates are fixed to each other by diffusion welding, for forming the laminated structure body having the at least one common ink chamber, the plurality of metal plates superposed on each other are heated while being gripped or pressed between a pair of members. In this instance, if the network of ink channels providing the at least one common ink chamber is fluid-tightly closed to shut up a gas (e.g., air) therein, the gas shut up in the network of ink channels is caused to expand and contract in the diffusion welding that is effected by heating the metal plates, whereby a pressure of the ink in the network is considerably fluctuated. Each of the at least one common ink chamber, which is held in communication with the plurality of nozzles so as to supply the ink to the respective nozzles, is formed to have a volume that is larger than that of the other part of the network of ink channel. Therefore, the fluctuation of the pressure in each of the at least one common ink chamber is likely to cause deformation of particularly, a portion of the laminated structure body that defines each of the at least one common ink chamber.

However, in the inkjet head constructed according to the present invention, the laminated structure body is formed with the atmosphere communication channel diverging from the network of ink channels and extending toward the exterior of the laminated structure body, so as to open outside of the laminated structure body in a process of manufacturing the inkjet head, thereby enabling the gas to be reliably evacuated from the network of ink channels toward the exterior of the laminated structure body through the atmosphere communication channel. The reliable evacuation of the gas in the process of manufacturing the inkjet head makes it possible to prevent the local deformation of the laminated structure body due to expansion and contraction of the gas in the diffusion welding, and also to prevent failure of fixation of the metal plates. Further, the atmosphere communication channel is sealed at its opening after the plurality of metal plates have been fixed to each other by the diffusion welding, so that the ink does not leak outside the laminated structure body through the atmosphere communication channel after the network of ink channels has been filled with the ink.

According to the second aspect of the invention, in the inkjet head defined in the first aspect of the invention, the atmosphere communication channel diverges from one of the at least one common ink chamber of the network of ink channels.

Since each of the at least one common ink chamber is provided to supply the ink to the plurality of nozzles, the volume of the common ink chamber is made relatively large. This means that the expansion and contraction of the gas within the common ink chamber could easily cause deformation of a portion of the laminated structure body defining the common ink chamber. However, in the inkjet head according to the second aspect of the invention, since the atmosphere communication channel diverges directly from one of the at least one common ink chamber, namely, is connected to one of the at least one common ink chamber, the gas can be reliably evacuated from the one of the at least one common ink chamber toward the exterior of the laminated structure body through the atmosphere communication channel, making it possible to reliably prevent deformation of the metal plates providing the laminated structure body.

According to the third aspect of the invention, in the inkjet head defined in the first or second aspect of the invention, the ink channel unit further defines a network of gas channels which provides at least one damper chamber each opposed to a corresponding one of the at least one common ink chamber, wherein the laminated structure body has, in addition to the at least one common ink chamber and the atmosphere communication channel as a first atmosphere communication channel, the at least one damper chamber and a second atmosphere communication channel that diverges from the network of gas channels, wherein the second atmosphere communication channel extends toward the exterior of the laminated structure body, so as to open outside the laminated structure body, and wherein the second atmosphere communication channel is sealed at an opening thereof Each of the at least one damper chamber is located in a position opposed to the corresponding one of the at least one common ink chamber, so as to absorb fluctuation of the pressure of the ink in the corresponding common ink chamber Each damper chamber is held in communication with an atmosphere, i.e., the exterior of the laminated structure body via a corresponding one of the gas channels, so as to effectively absorb the pressure fluctuation of the ink in the corresponding common ink chamber. Thus, each damper chamber is formed to have a volume that is larger than that of the other part of the network of gas channel. Where the plurality of metal plates are fixed to each other by the diffusion welding, for forming the laminated structure body having the at least one damper chamber in addition to the at least one common ink chamber, if the network of gas channels providing the at least one damper chamber is fluid-tightly closed to shut up the gas therein, the gas shut up in the network of gas channels is caused to expand and contract in the diffusion welding, whereby a pressure of the ink in the network is considerably fluctuated, thereby causing a risk of failure of fixation of the metal plates. Further, the pressure fluctuation of the pressure in the network of gas channels is likely to cause deformation of; particularly, a portion of the laminated structure body that defines each of the at least one damper chamber having the relatively large volume.

However, in the inkjet head constructed according to the third aspect of the invention, the laminated structure body is formed with the second atmosphere communication channel diverging from the network of gas channels and extending toward the exterior of the laminated structure body, so as to open outside of the laminated structure body in a process of manufacturing the inkjet head. This construction enables the gas to be reliably evacuated from the network of gas channels toward the exterior of the laminated structure body through the second atmosphere communication channel. Further, the second atmosphere communication channel is sealed at its opening after the plurality of metal plates have been fixed to each other by the diffusion welding, so as to prevent the ink from entering the network of gas channels via the second atmosphere communication channel, for thereby making it possible to maintain the function of the at least one damping chamber for damping the pressure fluctuation.

According to the fourth aspect of the invention, in the inkjet head defined in the third aspect of the invention, the network of ink channels defined by the ink channel unit further provides a plurality of pressure chambers which lie on a plane and which are held in communication with the plurality of nozzles and the at least one common ink chamber, wherein some of the plurality of pressure chambers at least partially overlap with the at least one common ink chamber as viewed in a superposed direction in which the plurality of metal plates of the laminated structure body are superposed on each other, wherein the laminated structure body further has a third atmosphere communication channel and at least one dummy chamber which is isolated from the network of ink channels and which is held in communication with the third atmosphere communication channel, and wherein the at least one dummy chamber overlaps with a part of some of the plurality of pressure chambers in the superposed direction, which part does not overlaps with the at least one common ink chamber in the superposed direction.

Where the plurality of pressure chambers are different from each other with respect to area opposed to or overlapping with the at least one common ink chamber, the pressure chambers are different from each other with respect to flexibility or compliance (i.e., inverse of rigidity). This means that there is a difference between the plurality of nozzles held in communication with the respective pressure chambers, with respect to ejection characteristics, which are exhibited by each nozzle upon ejection of the ink through the nozzle from the corresponding pressure chamber as a result of application of pressure to the ink in the pressure chamber by activation of an actuator. For reducing such a difference in the compliance between the pressure chambers, therefore, it is preferable that the laminated structure body has the at least dummy chamber as compliance adjuster that is located to overlap with a part of some of the plurality of pressure chambers, which part does not overlap with the at least one common ink chamber. However, if the gas is shut up in the at least one dummy chamber as well as in the ink and gas channels, the gas is caused to expand and contract when the plurality of metal plates are fixed to each other by the diffusion welding. In the inkjet head according to the third aspect of the invention, the laminated structure body is formed with the third atmosphere communication channel communicating between the at least one dummy chamber and the exterior of the laminated structure body, so that the gas can be reliably evacuated from the at least one dummy chamber toward the exterior of the laminated structure body through the third atmosphere communication channel.

The fifth aspect of the invention provides a process of manufacturing the inkjet head defined in any one of the above-described first through fourth aspects of the invention. This manufacturing process includes first, second and third steps, wherein the first step is implemented by forming the atmosphere communication channel in at least one of the plurality of metal plates, wherein the second step is implemented by fixing the plurality of metal plates to each other, by heating the plurality of metal plates, while the metal plates superposed on each other are being pressed between a pair of members having respective flat surfaces such that the flat surfaces of the pair of members are respectively held in contact with opposite end ones of the superposed metal plates, and wherein the third step is implemented by sealing the opening of the atmosphere communication channel after implementation of the second step In the manufacturing process according to the present invention, the atmosphere communication channel is formed in at least one of the metal plates in the first step, such that the atmosphere communication channel diverges from the network of ink channels, and extends toward an exterior of the laminated structure body so as to open outside the laminated structure body. In the second step following the first step, the metal plates are fixed to each other, by heating the metal plates, while the metal plates superposed on each other are being gripped or pressed between by the pair of members. Since the second step is implemented with presence of the atmosphere communication channel the gas can be reliably evacuated from the network of ink channels through the atmosphere communication channel during the second step, making it possible to prevent deformation of the metal plates arising from expansion and contraction of the gas. Further, since the atmosphere communication channel is sealed at its opening in the third step following the second step, the ink does not leak outside the laminated structure body through the atmosphere communication channel after the network of ink channels has been filled with the ink.

BRIEF DESCRIPTION OF THE DRAWINGS

The above and other objects, features, advantages and technical and industrial significance of the present invention will be better understood by reading the following detailed description of presently preferred embodiment of the invention, when considered in connection with the accompanying drawings, in which.

DETAILED DESCRIPTION OF THE PREFERRED EMBODIMENT

Figure 1:
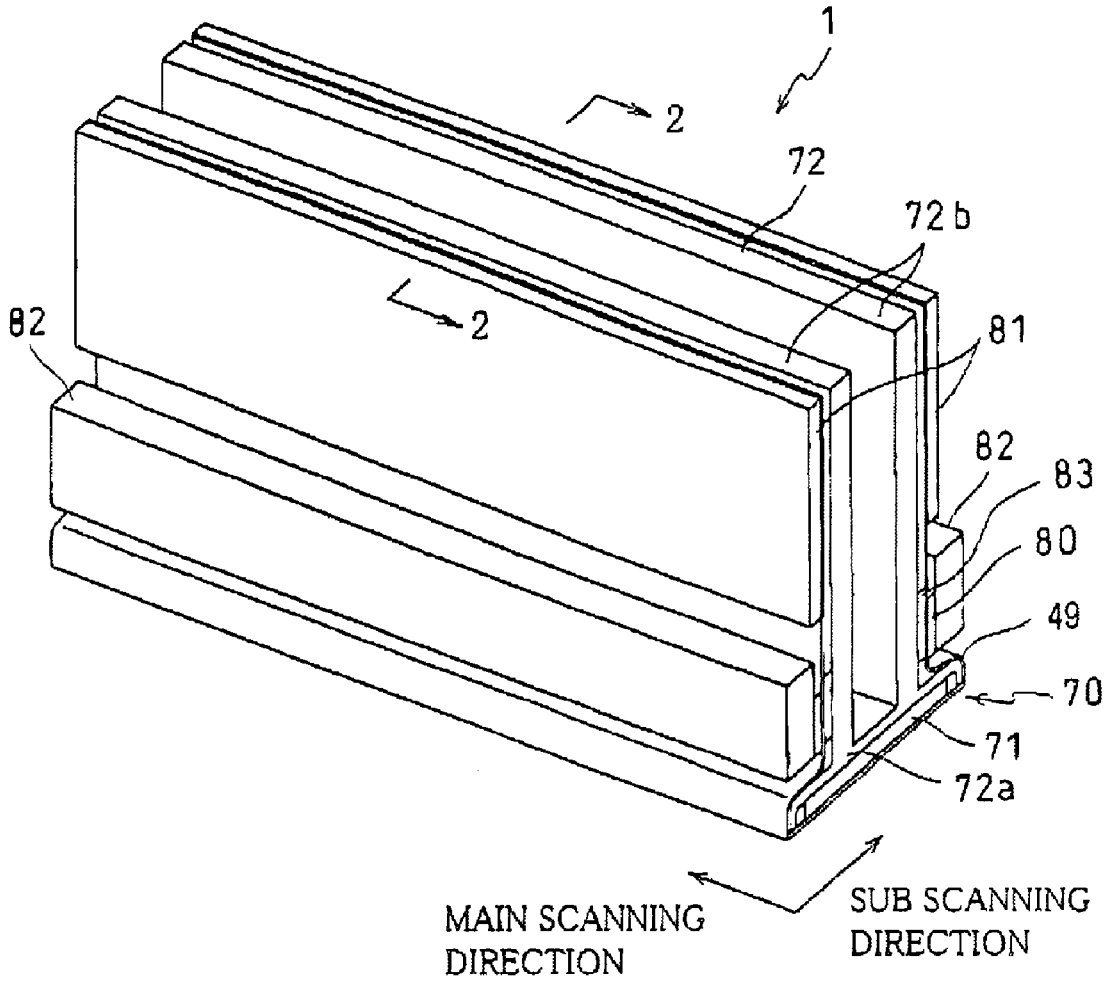
FIG. 1 is a perspective view of an inkjet head constructed according to an embodiment of the invention.
Figure 2:
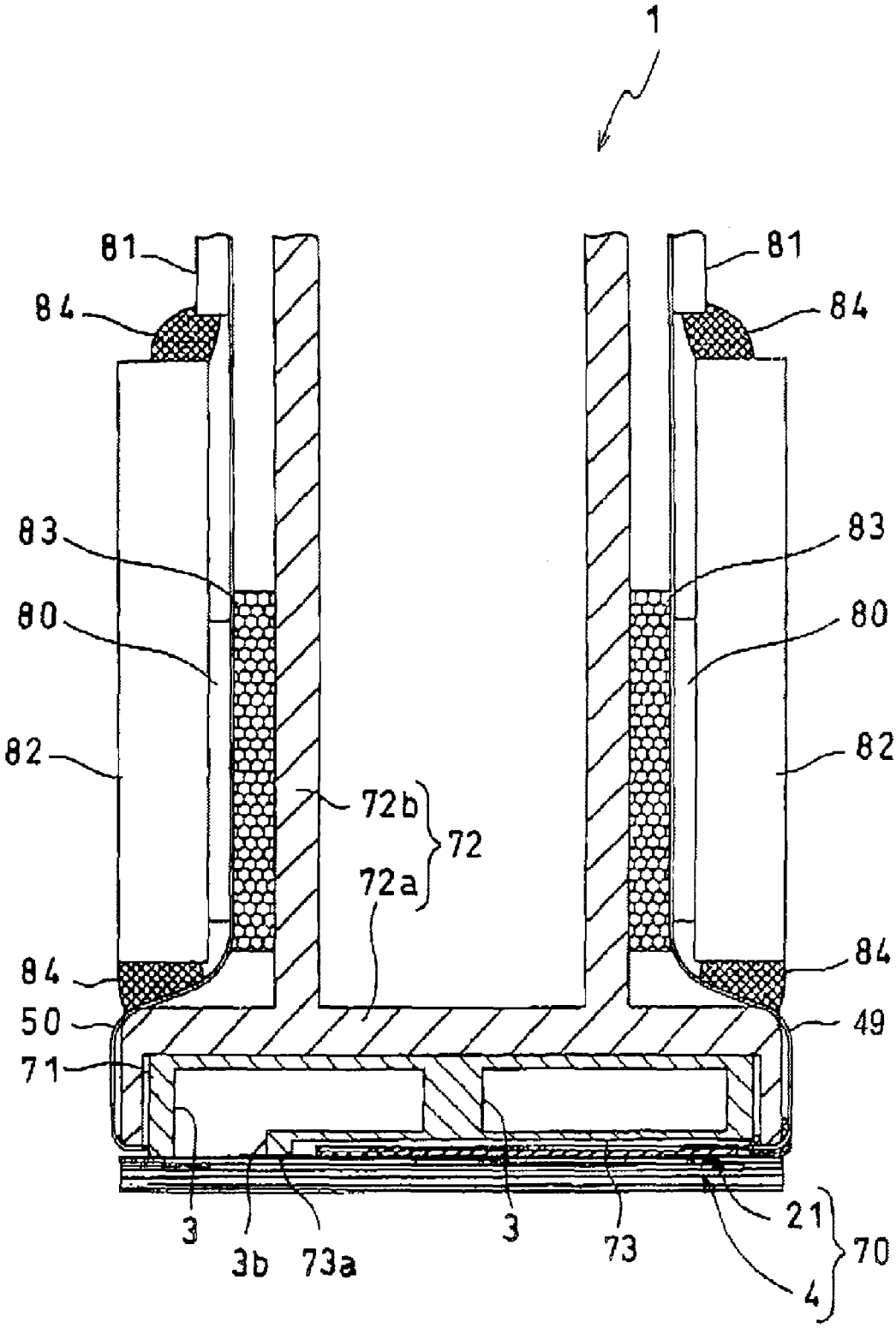
FIG. 2 is a cross sectional view taken along line 2-2 of FIG. 1.

There will be described an embodiment of the present invention with reference to the accompanying drawings. FIG. 1 is a perspective view of an inkjet head 1 constructed according to the embodiment of the invention, while FIG. 2 is a cross sectional view taken along line 2-2 of FIG. 1. This inkjet head 1 is to be installed on an inkjet printer (not shown), so as to be operable to perform a recording operation, by ejecting an ink toward a recording medium (e.g., paper sheet) that is fed by a feeding device of the inkjet printer. As shown in FIGS. 1 and 2, the inkjet head 1 includes: a main body 70 which has a rectangular flat surface elongated in a main scanning direction of the printer and which is operable to eject the ink toward the recording medium; a base block 71 which is disposed above the main body 70 and which defines therein two ink storage chambers 3; and a holder 72 which holds the main body 70 and the base block 71. It is noted that each of the two ink storage chambers 3 serves as an ink passage through which the ink is to be supplied to the main body 70.

The main body 70 of the inkjet head 1 includes an ink channel unit 4 defining ink channels 32 (see FIG. 5), and a plurality of actuator units 21 bonded to an upper surface of the ink channel unit 4. In the present embodiment, a total of four actuator units 21 are arranged in a longitudinal direction of the ink channel unit 4 (see FIG. 3). Each of the ink channel unit 4 and actuator units 21 includes a thin-plate-shaped laminated structure body provided by a plurality of thin plates that are superposed on one another and fixed to one another. As shown in FIG. 2, a FPC (flexible printed circuit) 49 is bonded to an upper surface of each of the actuator units 21, and extends therefrom in right and left directions (as seen in FIG. 2). The base block 71 is formed of for example, a metallic material such as stainless steel Each of the ink storage chambers 3 of the base block 71 is provided by a substantially rectangular-parallelepiped-shaped hollow region of the base block 71 that is elongated in its longitudinal direction.

The base block 71 includes a lower surface 73 opposed to the ink channel unit 4 and having a protruding portion 73*a* which protrudes downwardly and which is located in the vicinity of an opening 3*b* of each of the ink storage chambers 3. The base block 71 is held in contact only at the protruding portion 73*a* with the ink channel unit 4, and is spaced apart from the ink channel unit 4 at its portion other than the protruding portion 73*a*. Each of the actuator units 21 is disposed in a space between the base block 71 and the ink channel unit 4.

The holder 72 includes a holding portion 72*a* and a pair of flat-plate-shaped projecting portions 72*b* projecting vertically from an upper Surface of the holding portion 72*a*. The base block 71 is bonded to be fixedly received in a recess that is formed in a lower surface of the holding portion 72*a* of the holder 72. The FPC 49 bonded to each of the actuator units 21 is arranged to extend along a surface of each of the projecting portions 72*b* of the holder 72. An elastic member 83 such as sponge is interposed between the FPC 49 and the surface of each of projecting portions 72*b*. A driver IC 80 is fixed to the FPC 49, so that a drive signal outputted from the driver IC 80 can be transmitted to the actuator unit 21 which is electrically connected to the FPC 49 by soldering.

A generally rectangular parallelepiped-shaped heatsink 82 is held in close contact with an outside surface of the driver IC 80, for dissipating heat generated by the driver IC. 80 to an exterior of the inkjet head 1. In a position above the driver IC 80 and heatsink 82 and outside of the FPC 49, there is disposed a substrate 81 that is electrically connected to the drive IC 80 through the FPC 49. It is noted that a gap between an upper surface of the heatsink 82 and the substrate 81 and a gap between a lower surface of the heatsink 82 and the FPC 49 are filled with a sealer 84 for preventing dust or ink from entering the inkjet head 1.

Figure 3:
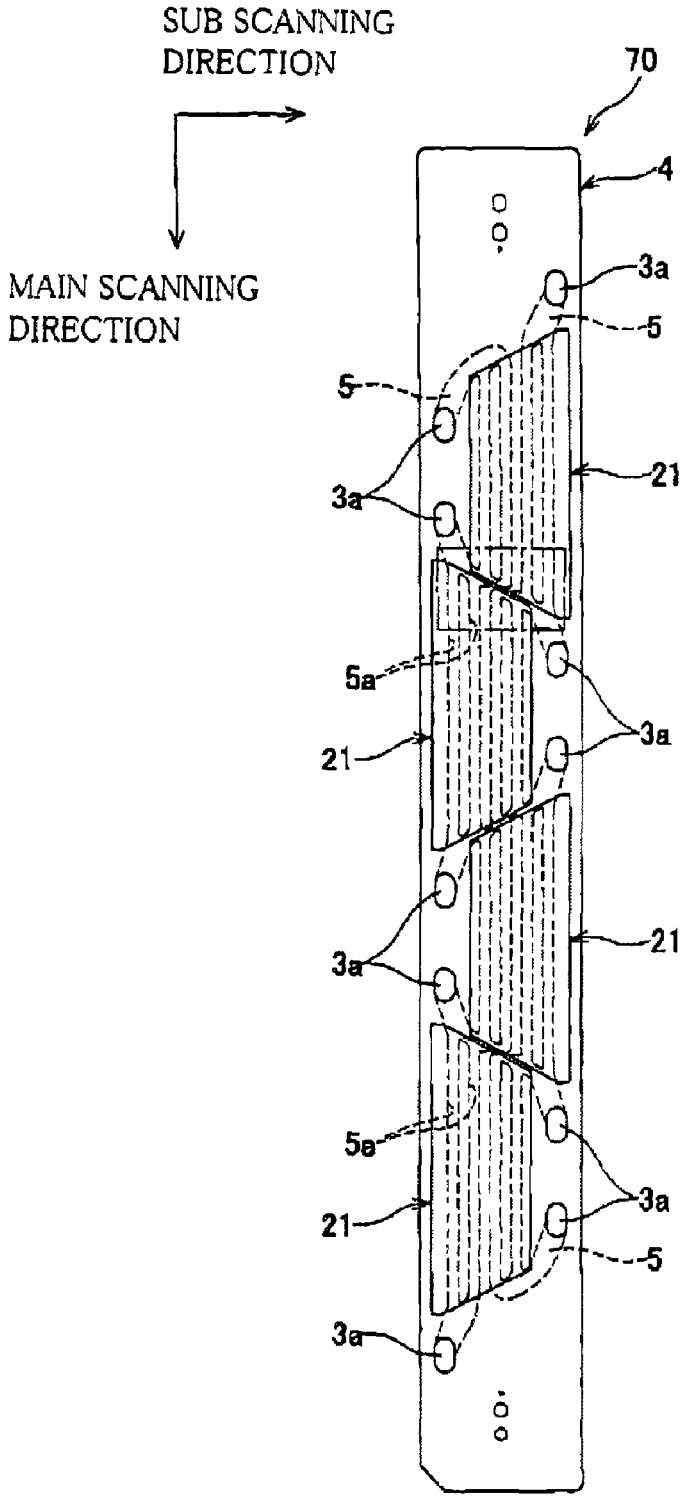
FIG. 3 is a plan view of a main body of the inkjet head of FIG. 1.

FIG. 3 is an upper plan view of the main body 70 of the inkjet head 1. As shown in FIG. 3, the ink channel unit 4 has a rectangular flat shape that is elongated in a predetermined direction (in the main scanning direction). The ink storage chambers 3 are held in communication at their openings 3*b* (see FIG. 2) with manifold chambers 5 that are formed in the ink channel unit 4. Each of the manifold chambers 5 has an end portion at which the chamber 5 is forked or divided into a plurality of sub manifold chambers 5a extending in a longitudinal direction of the ink channel unit 4. Each of the manifold chambers 5 and the sub manifold chambers 5*a* diverging from the manifold chamber 5 cooperate to constitute a common ink chamber.

Figure 4:
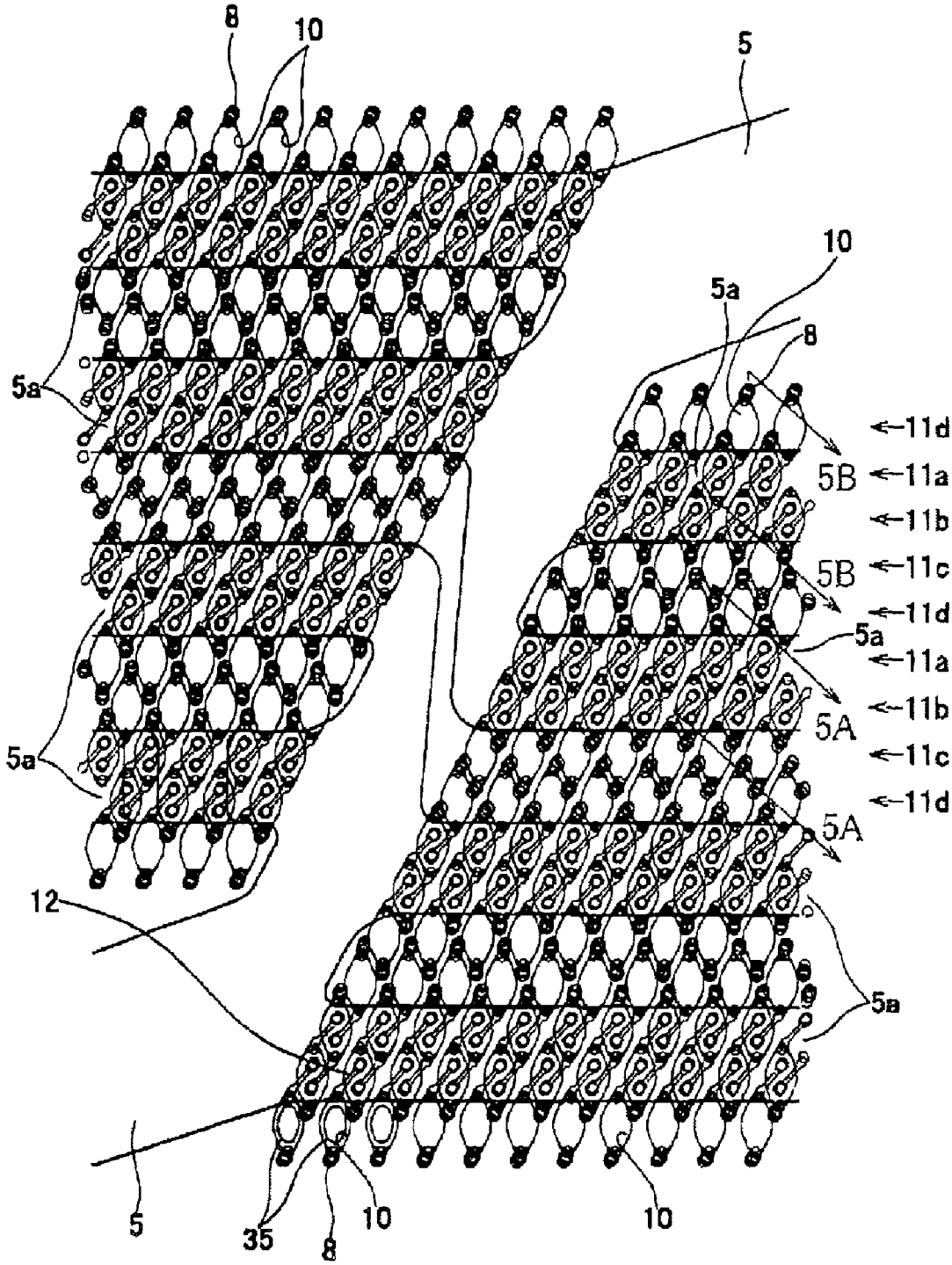
FIG. 4 is an enlarged view of a region surrounded by one-dot chain line of FIG. 3.

In the ink channel unit 4, there are provided four trapezoidal-shaped regions in each of which a plurality of pressure chambers 10 and a plurality of nozzles 8 are arranged (see FIG. 4). The four actuator units 21, each having a trapezoidal shape in its plan view, are bonded to the upper surface of the ink channel unit 4, such that the actuator units 21 are aligned with the respective trapezoidal-shaped regions of the ink channel unit 4. The actuator units 21 are arranged in two rows or columns in a zigzag pattern or in a staggered fashion, without interfering openings 3*a*, such that parallel opposed sides (upper and lower sides) of the trapezoidal shape of each of the actuator unit 21 extends in the longitudinal direction of the ink channel unit 4. The plurality of openings 3*a* are arranged in two rows or columns extending in the longitudinal direction, without interfering the actuator units 21. In the present embodiment, the number of the openings 3*a* is ten, such that a total of five openings 3*a* cooperate to form each one of the two columns. Each adjacent pair of the actuator units 21 are positioned relative to each other such that oblique sides of the respective actuator units 21 (adjacent to each other) are partially overlap with each other in a width direction of the ink channel unit 4 (in a sub scanning direction of the printer). Below each of the actuator units 21, a total of four sub manifold chambers 5*a* are arranged to extend.

FIG. 4 is an enlarged view of a region surrounded by one-dot chain line of FIG. 3. The ink channel unit 4 has an upper portion in which the plurality of pressure chambers 10 are formed to lie on a plane and to be arranged in a matrix, as shown in FIG. 4. The ink channel unit 4 has a lower portion serving as an ink ejection region in which the plurality of nozzles 8 held in communication with the respective pressure chambers 10 are arranged in a matrix.

As shown in FIG. 4, the plurality of pressure chambers 10 are arranged in a plurality of rows or columns 11*a*, 11*b*, 11*c*, 11*d* extending in a direction in which the sub manifold chambers 5*a* extend (in right and left directions as seen in FIG. 4). Each of the pressure chambers 10 has a diamond-like shape in its plan view. Each corner of the diamond-like shape is rounded, and a longer one of diagonal lines of the diamond-like shape is held parallel to the width direction of the ink channel unit 4. Each pressure chamber 10 is held in communication at one of its opposite end portions with the corresponding nozzle 8, and is held in communication at the other of its opposite end portions with the corresponding sub manifold chamber 5*a* via an aperture 12 (see FIGS. 5A and 5B). Individual electrodes 35 are disposed in positions overlapping with the respective pressure chambers 10 in the plan view. Each of the individual electrode 35 has a shape similar to and slightly smaller than the shape of the corresponding pressure chamber 10. It is noted that only some of the multiplicity of individual electrodes 35 are illustrated in FIG. 4, for simplifying the drawing, and that the pressure chambers 10, apertures 12 and nozzles 8 formed in the ink channel unit 4 are represented by solid lines in FIG. 4, instead of being represented by broken lines, for easier understanding of the drawing.

Figure 5A:
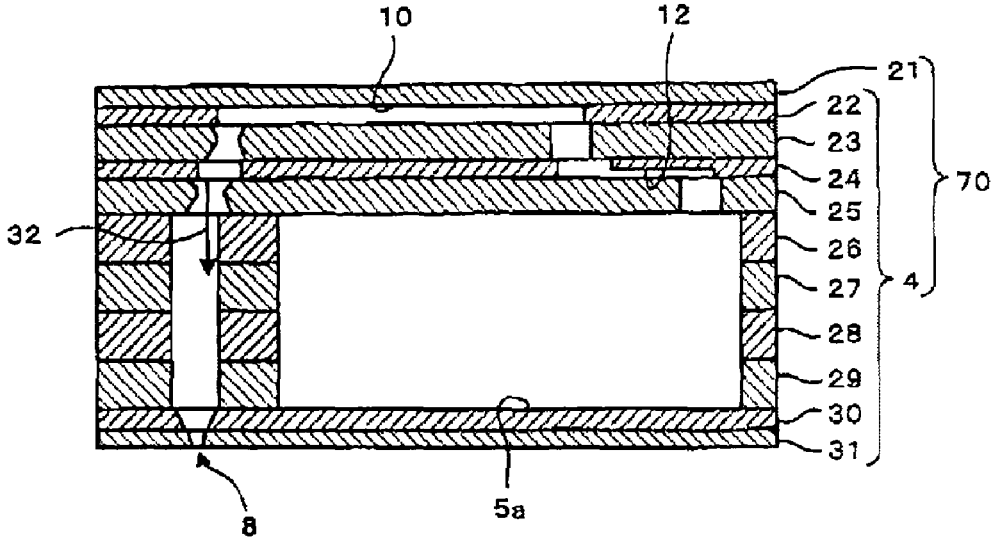
FIG. 5A is a cross sectional view taken along line 5A-5A of FIG. 4.
Figure 5B:
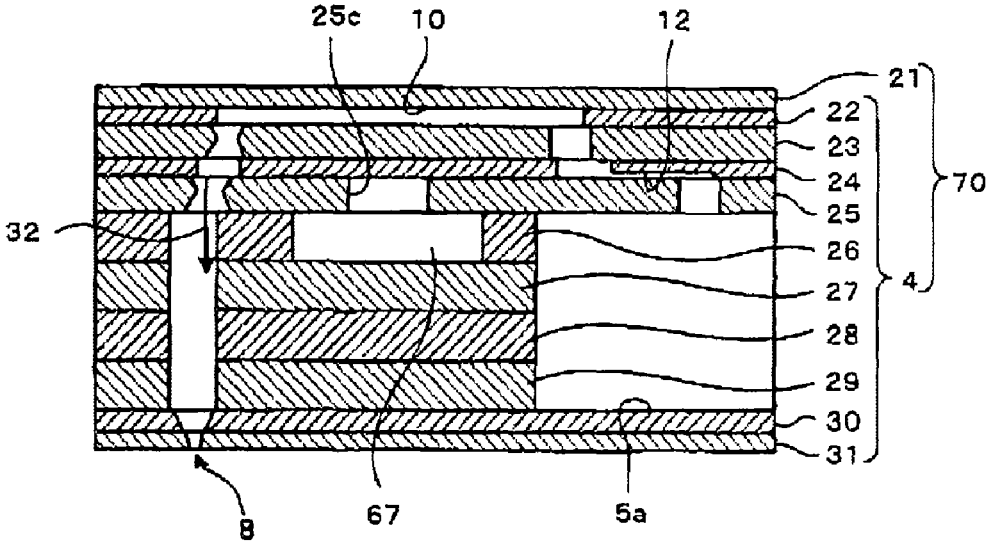
FIG. 5B is a cross sectional view taken along line 5B-5B of FIG. 4.
Figure 6:
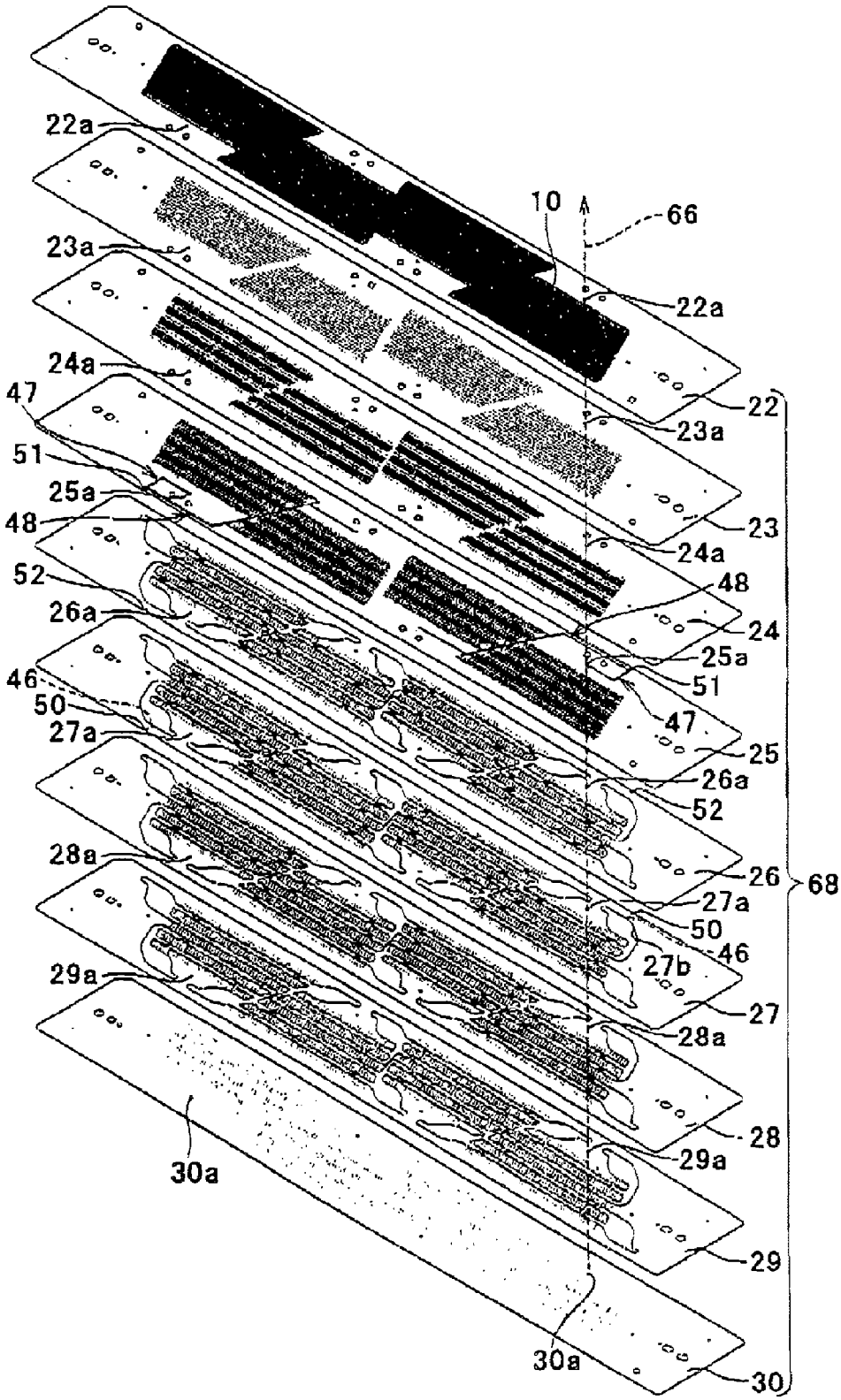
FIG. 6 is a perspective and exploded view of metal plates (not including a nozzle plate) that are superposed on each other to constitute an ink channel unit of the inkjet head.

Referring next to FIGS. 5A, 5B and 6, there will be a construction of the main body 70 of the inkjet head 1. FIG. 5A is a cross sectional view taken along line 5A-5A of FIG. 4, while FIG. 5B is a cross sectional view taken along line 5B-5B of FIG. 4. As shown in FIGS. 5A and 5B, the nozzle 8 is held in communication the sub manifold chamber 5*a* via the pressure chamber 10 and the aperture 12. That is, in the main body 70 of the inkjet head 1, there are formed the plurality of ink channels 32 each provided by the manifold chamber 6, sub manifold chamber 5*a*, aperture 12, pressure chamber 10 and nozzle 8.

The main body 70 of the inkjet head 1 includes the actuator units 21 and the ink channel unit 4 that is provided by ten plates 22-31 superposed on one another.

Each of the actuator unit 21 is provided by four piezoelectric sheets 41-44 (see FIG. 12) superposed on one another. The piezoelectric sheets 41-44 are made of PZT dead zirconate titanate) based ceramic material and having ferroelectricity. Among the four piezoelectric sheets 31-34, the uppermost sheet 31 is an active layer including portions which serve as active portions upon generation of electric field thereacross, while the other sheets 32-34 are inactive layers including no active portion.

The ten plates 22-31 providing the ink channel unit 4 consist of a cavity plate 22, a base plate 23, an aperture plate 24, a supply plate 25, manifold plates 26, 27, 28, 29, a cover plate 30 and a nozzle plate 31, each of which is a metal plate made of stainless steel or the like.

In the cavity plate 22, the plurality of pressure chambers 10 are formed to be arranged in a matrix. In the base plate 23, there are formed communication holes each communicating the corresponding pressure chamber 10 and the corresponding aperture 12, and communication holes each communicating the corresponding pressure chamber 10 and the corresponding nozzle 8. In the aperture plate 24, there are formed the apertures 12 each provided by a groove formed by half-etching, and communication holes each communicating the corresponding pressure chamber 10 and the corresponding nozzle 8. In the supply plate 25, there are formed communication holes each communicating the corresponding apertures 12 and the corresponding sub manifold chamber 5*a*, and communication holes each communicating the corresponding pressure chamber 10 and the corresponding nozzle 8. In the manifold plates 26-29 (common-ink-chamber defining plate), there are formed the manifold chambers 5 (see FIGS. 3 and 4), the sub manifold chambers 5*a* diverging from the manifold chambers 5, and communication holes each communicating the corresponding pressure chamber 10 and the corresponding nozzle 8. In the cover plate 30, there are formed communication holes each communicating the corresponding pressure chamber 10 and the corresponding nozzle 8. In the nozzle plate 31, there are formed the plurality of nozzles 8 that are arranged in a matrix.

The ten metal plates 22-31 are superposed on one another, while being positioned relative to one another such that the ink channels 32 are established as shown in FIGS. 5A and 5B Each of the ink channels 32 extends upwardly from the corresponding sub manifold chamber 5*a* diverging from the corresponding manifold chamber 5, extends horizontally in the corresponding aperture 12, extends further upwardly from the corresponding aperture 12 to the corresponding pressure chamber 10, extends further horizontally in the corresponding pressure chamber 10, extends from the corresponding pressure chamber 10 in a diagonally downward direction away from the corresponding aperture 12 by a predetermined distance, and then extends to the corresponding nozzle 8 in a downward direction perpendicular to the direction in which the sheets 22-30 are laminated. Each ink channel 32 is constructed to have a generally upwardly convexed shape as a whole, such that the corresponding pressure chamber 10 is located in an upper end of the upwardly convexed shape.

Figure 7:
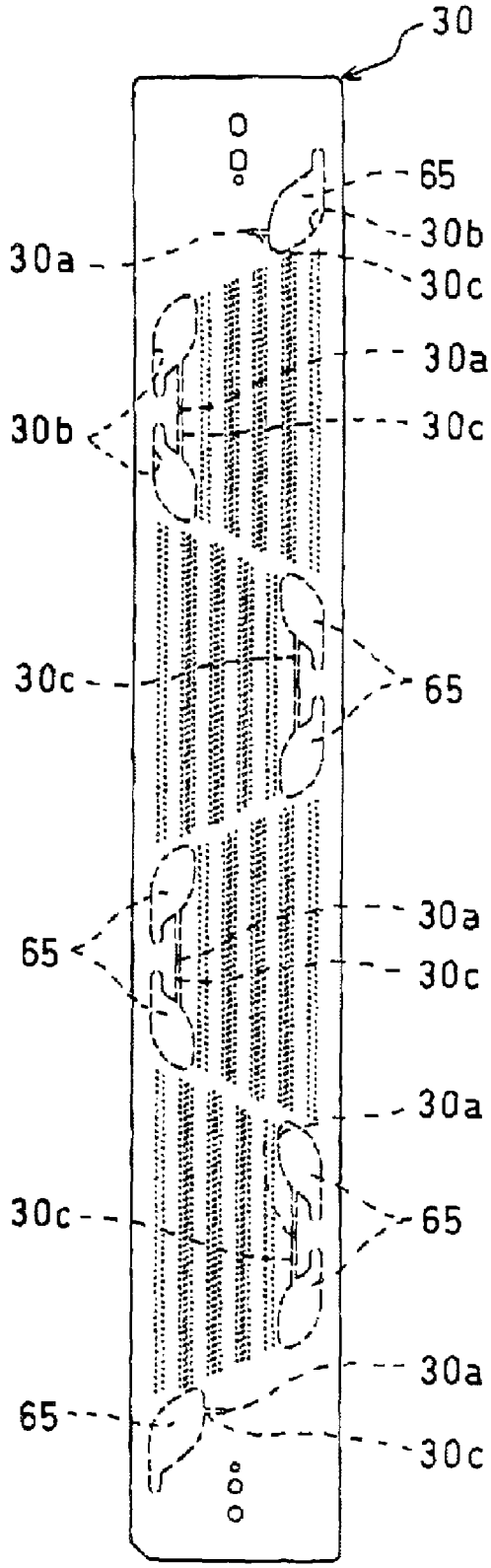
FIG. 7 is a plan view of a cover plate that is one of the metal plates of FIG. 6.

As shown in FIG. 7 that is an upper plan view of the cover plate 30, recesses 30*b* are formed in a lower surface of the cover plate 30 by half-etching. That is, the recesses 30*b* are formed in a lower surface of the cover plate 30 that is to be contact with the nozzle plate 31, so as to be located in respective positions opposed to the respective openings 3*a* that are held in communication with the respective manifold chambers 5 (see FIG. 3). The recesses 30*b* are closed by the nozzle plate 31 so as to constitute respective damper chambers 65. Each of the damper chambers 65 serves to absorb fluctuation of pressure propagated from the pressure chamber 10 to the manifold chamber 5 when the ink within the pressure chamber 10 is pressurized by activation of the actuator unit 21. The cover plate 30 further has grooves 30*c* and atmosphere communication holes 30*a* such that the grooves 30*c* extend from the respective damper chambers 65 and are connected to the atmosphere communication holes 30*a*. As shown in FIG. 6, each of the atmosphere communication holes 30*a* is connected to atmosphere communication holes 29*a*, 28*a*, 27*a*, 26*a*, 25*a*, 24*a*, 23*a*, 22*a* formed in respective eight plates 22-29 that are located above the cover plate 30. The groove 30*c*, atmosphere communication holes 22*a*-30*a* and damper chambers 65 cooperate to constitute gas channels 66 through which the damper chambers 65 are held in communication with the atmosphere, i.e., the exterior of the ink channel unit 4, so that fluctuation of the pressure of the ink in the manifold chambers 5 can be further effectively absorbed by the damper chambers 65. Further, since each of the gas channels 66 is open in the cavity plate 22 that is opposite to the nozzle plate 31, the opening (atmosphere communication hole 22*a*) of each gas channel 66 is positioned to be distant from the nozzles 8, thereby minimizing risk of entrance of the ink into the gas channels 66. In the present embodiment, each of the atmosphere communication holes 30*a* is located in a position that is distant from a corresponding adjacent pair of the damper chambers 65 by substantially the same distance. This arrangement enables the adjacent pair of the damper chambers 65 to have substantially the same characteristics with respect to absorption of the pressure fluctuation.

As shown in FIG. 4, the plurality of pressure chambers 10 are arranged in the plurality of columns 11*a*-11*d* extending in the main scanning direction (in the right and left direction as seen in FIG. 4). Among the pressure chambers 10 in the plurality of columns 11*a*-11*d*, each of the pressure chambers 10 arranged in the columns 11*a*, 11*b* overlaps or is opposed in its major part to a corresponding one of the sub manifold chambers 5*a*, while each of the pressure chambers 10 arranged in the columns 11*c*, 11*d* overlaps or is opposed only in its minor part to a corresponding one of the sub manifold chambers 5*a*. That is, each pressure chamber 10 belonging to the column 11*a* or 11*b* is different from each pressure chamber 10 belonging to the columns 11*c* or 11*d*, with respect to its area that is opposed to the corresponding sub manifold chamber 5*a*, so that there is caused a difference among the pressure chambers 10 with respect to flexibility or compliance (i.e., inverse of rigidity) between the pressure chambers 10. The difference among the pressure chambers 10 in the compliance leads to a difference among the nozzles 8 in the ejection characteristics such as volume and velocity of droplet of the ink ejected through each nozzle 8, resulting in deterioration in the quality of printed images. To avoid such a deterioration, in the present embodiment, a dummy chamber 67 (compliance adjusting space) is formed in a position opposed to each pressure chamber 10 of the columns 11*c*, 11*d* that is opposed in its small area to the corresponding sub manifold chamber 5*a*, for reducing a rigidity of a wall defining the pressure chamber 10 and accordingly increasing the compliance of the pressure chamber 10.

Figure 8:
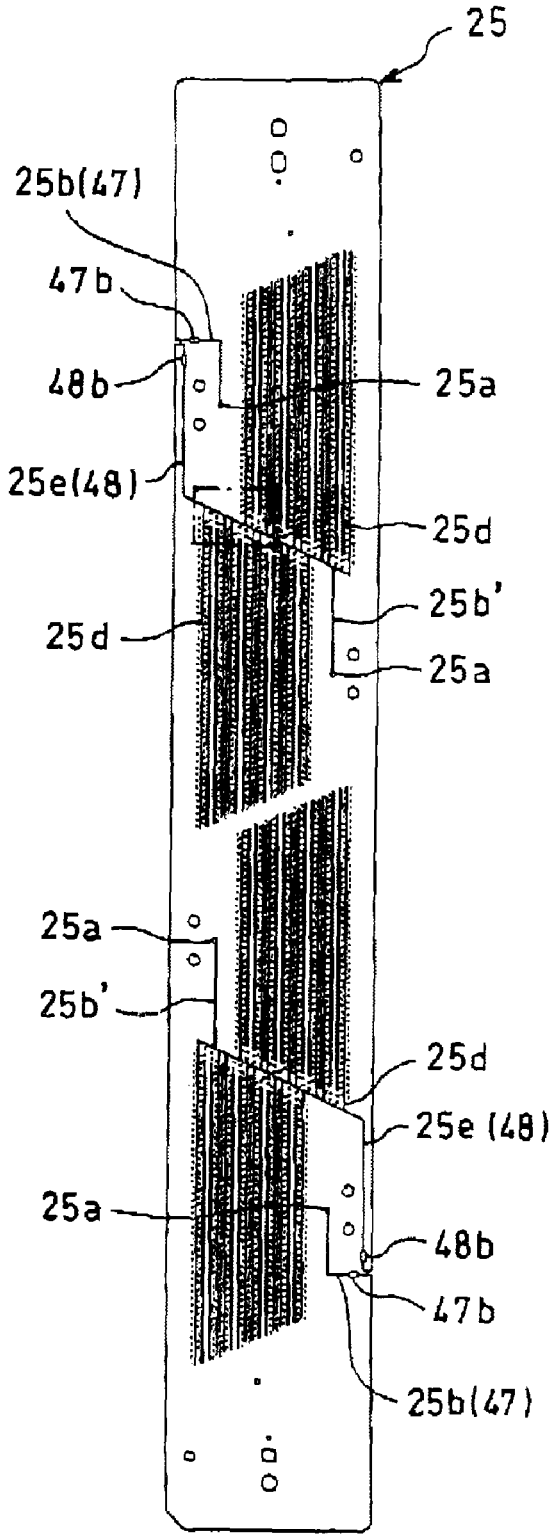
FIG. 8 is a plan view of a supply plate that is one of the metal plates of FIG. 6.
Figure 9:
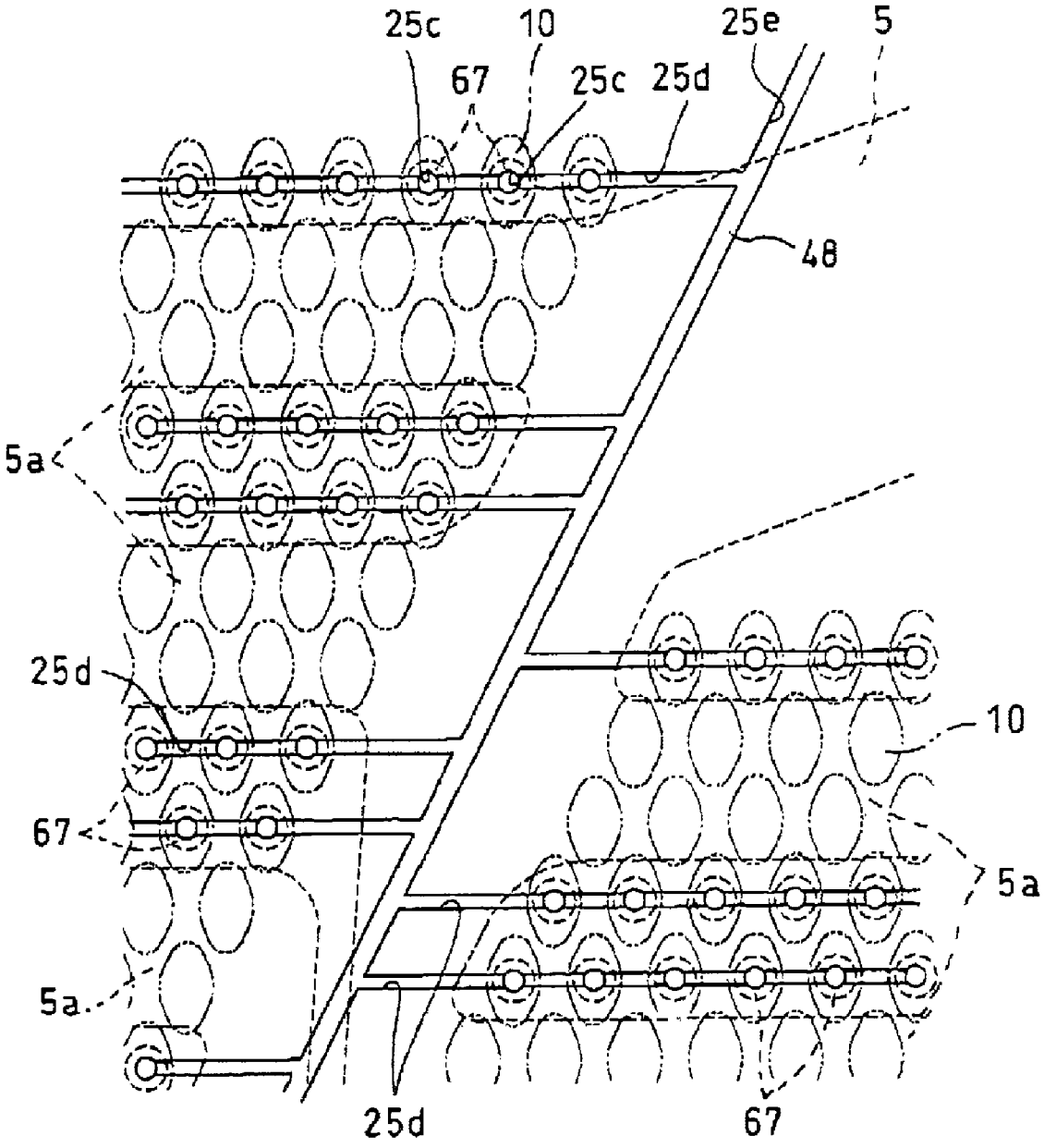
FIG. 9 is an enlarged view of a region surrounded by one-dot chain line of FIG. 8.

FIG. 8 is an upper plan view of the supply plate 25, while FIG. 9 is a view showing a region surrounded by one-dot chain line in FIG. 8. In FIG. 9, for easier understanding of the drawing, the pressure chambers 10 located above the supply plate 25 are represented by two-dot chain lines, while the dummy chamber 67, manifold chambers 5 and sub manifold chambers 5*a* located below the supply plate 25 are represented by dotted lines. As shown in FIG. 5B and FIG. 9, each of the dummy chambers 67 is provided by a hole having a circular cross sectional shape and provided in a portion of the manifold chamber 26 that is opposed to the corresponding pressure chamber 10. Thus, the plurality of dummy chambers 67 corresponding to the respective pressure chambers 10 are arranged in the main scanning direction (i.e., in right and left directions as seen in FIG. 9).

Figure 14:
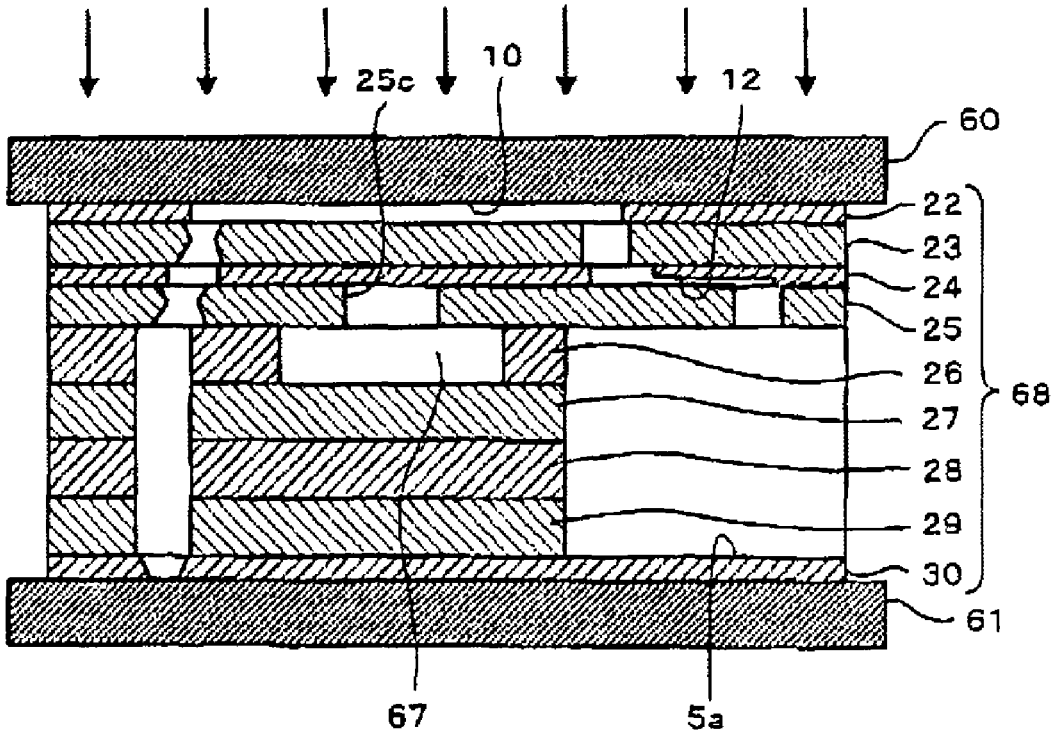
FIG. 14 is a view illustrating an operation performed in a diffusion welding step of the manufacturing process.

In the inkjet head 1 constructed according to the present invention, among the ten metal plates 22-31 constituting the ink channel unit 4, nine metal plates 22-30 excluding the nozzle plate 31 are once fixed to each other by diffusion welding, while being superposed on one another. In this instance, as shown in FIG. 14, the nine metal plates 22-30 are fixed to each other, by heating the metal plates 22-30 at a high temperature (about 1000° C.) under a vacuum condition, while the superposed metal plates 22-30 are gripped or pressed between a pair of jig members 60, 61 having respective flat contact surfaces 60*a*, 61*a* such that the flat contact surfaces 60*a*, 61*a* of the jig members 60, 61 are held respectively held in contact with upper and lower end plates 22, 30. A laminated structure body 68 is constituted by the nine metal plates 22-30 thus fixed to one another.

The nine metal plates 22-30 fixedly superposed on each other cooperate to define two networks of the ink channels 32 which provide the manifold chambers 5 each having a large volume, the sub manifold chambers 5*a* and the pressure chambers 10. As shown in FIGS. 5A, 5B and 6, the networks of the ink channels 32 open only in the upper and lower end plates (cavity and cover plates) 22, 30. The openings opening in the upper and lower end plates 22, 30 are fluid-tightly closed by the jig members 60, 61 in a process of the diffusion welding described above. Thus, an air is shut up in the ink channels 32, and the air shut up in the ink channels 32 is caused to expand and contract in the process of the diffusion welding that includes a heating step and a cooling step following the heating step, leading to considerable fluctuation of a pressure of the air and accordingly causing a failure of fixation of the metal plates 22-30. The same problem could be caused also in networks of the gas channels 66 providing the damper chambers 65 and opening only at the atmosphere communication holes 22*a*, and in the dummy chambers 67 formed in the manifold plate 26 for adjusting the above-described compliance.

In the inkjet head 1 according to the present embodiment, however, the nine metal plates 22-30 constituting the laminated structure body 68 are formed with first atmosphere communication channels 46 for bringing the respective networks of the ink channels 32 (providing the manifold chambers 5, sub manifold chambers 5*a* and pressure chambers 10) into the atmosphere, second atmosphere communication channels 47 for bringing the respective networks of the gas channels 66 (providing the damper chambers 65) into the atmosphere, and third atmosphere communication channels 48 for bringing the dummy chambers 67 into the atmosphere.

Figure 10:
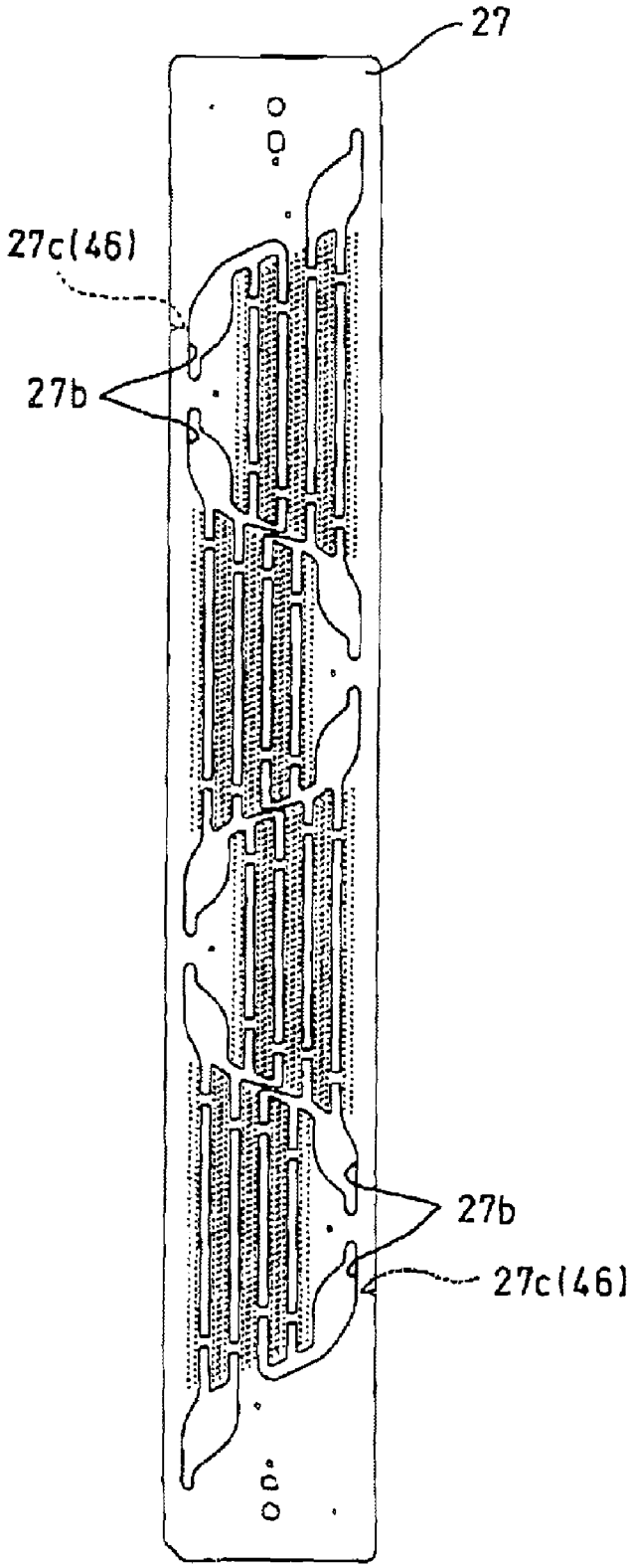
FIG. 10 is; a plan view of one of four manifold plates that corresponds to a second uppermost of the four manifold plates as seen in FIG. 6.

FIG. 10 is an upper plan view of the manifold plate 27. As shown in FIG. 10, in a lower surface of the manifold plate 27, there are formed two grooves 27*c* (represented by broken lines in the figure) that extend from respective two holes 27*b* as parts of the respective manifold chambers 5 of the respective networks of the ink delivery channels 32, up to respective two longitudinally-extending side surfaces of the manifold plate 27 (i.e., right- and left-side surfaces of the manifold plate 27 as seen in FIG. 10). Each of the grooves 27*c* is formed by half-etching, and constitutes a corresponding one of the first atmosphere communication channels 46. That is, each of the first atmosphere communication channels 46 diverges directly from the corresponding manifold chamber 5, thereby making it possible to reliably evacuate the air contained in the manifold chambers 5 each having the largest volume, via the first atmosphere communication channel 46.

Further, as shown in FIGS. 6 and 8, in an upper surface of the supply plate 25, there are formed two grooves 25*b* that diverge from the respective gas channels 66 at the atmosphere communication holes 25*a* and extend up to respective two longitudinally-extending side surfaces of the supply plate 25 (i.e., right- and left-side surfaces of the supply plate 25 as seen in FIG. 8). Each of the grooves 25*b* is formed by half-etching, and constitutes a corresponding one of the second atmosphere communication channels 47. It is therefore possible to reliably evacuate the air contained in the networks of the gas channels 66 (providing the damper chambers 65). It is noted that, in the present embodiment in which four gas channels 66 are formed in the ink channel unit 4, two of the four atmosphere communication holes 25*a*, which are located in a longitudinally central portion of the supply plate 25, are connected to respective grooves 25*e* through respective grooves 25*b*' that are adjacent to the respective two atmosphere communication holes 25*a*.

Further, as shown in FIGS. 5B and 9, in the supply plate 25, there are formed a plurality of communication holes 25*c* that are connected to the respective dumper chambers 67 arranged in the main scanning direction (i.e., right and left directions as shown in FIG. 9). Meanwhile, as shown in FIGS. 6 and 9, in the upper surface of the supply plate 25, a plurality of grooves 25*d* and the above-described plurality of grooves 25*e* are formed by half-etching. The grooves 25*d* are connected to the respective communication holes 25*c* and extend in the main scanning direction, while the grooves 25*e* are connected to the respective grooves 25*d*. The communication holes 25*c* and grooves 25*d*, 25*e* cooperate to constitute the third atmosphere communication channels 48 opening to the atmosphere. It is therefore possible to reliably evacuate the air contained in the dummy chambers 67 through the third atmosphere communication channels 48. It is noted that, in the present embodiment, each of the third atmosphere communication channels 48 is connected to a corresponding one of the second atmosphere communication channels 47 in a vicinity of their openings to the atmosphere.

As is apparent from the above description, the first, second and third atmosphere communication channels 46, 47, 48 are provided for evacuating the air in process of the diffusion welding. If the first, second and third atmosphere communication channels 46, 47, 48 were held in communication with the atmosphere even after assembling the inkjet head 1, the ink would leak from the first atmosphere communication channels 46 diverging from the ink channels 32. Further, in that case, the ink would enter the damper chambers 65 and the dummy chambers 67 through the second and third atmosphere communication channels 47, 48. To avoid such problems, the first and second atmosphere communication channels 46, 47 are sealed at their openings 46*a*, 47*a* with a sealer 54 that is formed oft for example, epoxy resin.

Figure 11A:
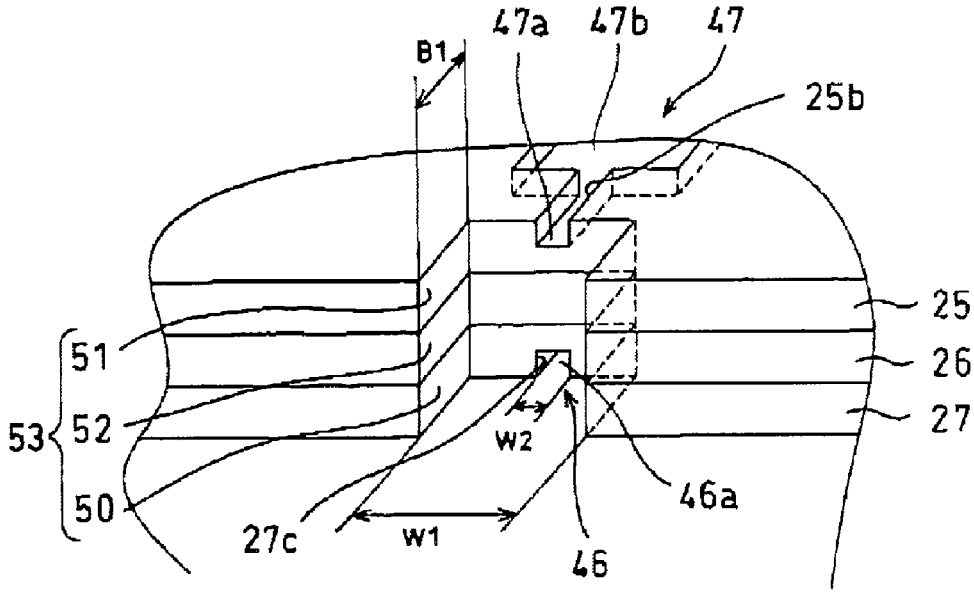
FIG. 11A is an enlarged perspective view showing three of the metal plates of FIG. 6 in which a recess is formed.

As shown in FIG. 11A, the openings 46*a*, 47*a* of the first and second atmosphere communication channels 46, 47 both open in respective side surfaces of the manifold plate 27 and the supply plate 25 which constitute a same surface of the laminated structure body 68. The opening 46*a* of the first atmosphere communication channel 46 opens to the atmosphere through a cutout 50 (first cutout) that is formed in a side portion of the manifold plate 27. The opening 47*a* of the second atmosphere communication channel 47 opens to the atmosphere through a cutout 51 (second cutout) that is formed in a side portion of the supply plate 25. As shown in FIG. 11A, the cutouts 50, 51 of the respective plates 27, 25 have substantially the same width. Further, the manifold plate 26 interposed between the plates 27, 25 has a cutout 52 located in a position overlapping with the cutouts 50, 51 and having substantially the same width as the cutouts 50, 51. The cutouts 50, 51, 52 connected to one another cooperate to provide a recess 53 in which the two openings 46*a*, 47*a* are held in communication with each other. Thus, the recess 53 is formed through the three plates 25, 26, 27 that are superposed on one another.

Figure 11B:
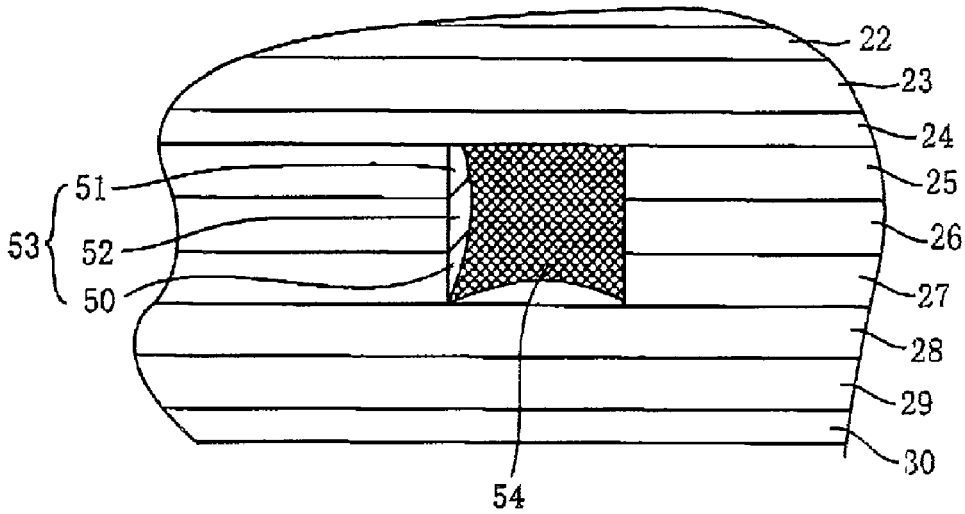
FIG. 11B is an enlarged perspective view showing the recess and its vicinity after a sealer is applied in the recess.

The recess 53 has a width W1 of, for example, about 1 mm and a depth B1 of, for example, 0.5 mm, as shown in FIG. 11A. The width W1 and the depth B1 are sufficiently larger than a width W2 of the openings 46*a*, 47*a* that is, for example, about 0.1 mm. That is, an area of a cross section of the recess 53 perpendicular to a horizontal surface of each of the metal plates, namely, an opening area through which the recess 53 opens to the atmosphere, is larger than a cross sectional area of each of the openings 46*a*, 47*a* of the first and second atmosphere communication channels 46, 47. The recess 53 thus having a large volume is charged with the sealer 54, as shown in FIG. 11B, and the sealer 54 is caused by a capillary attraction, to be drawn or flow into the first and second atmosphere communication channels 46, 47 through the respective openings 46*a*, 47*a* each having the cross sectional area smaller than that of the recess 53, whereby the first and second atmosphere communication channels 46, 47 can be easily and reliably sealed at their openings 46*a*, 47*a* by the sealer 54. Further, the first and second atmosphere communication channels 46, 47 can be thus sealed concurrently with each other.

In this instance, there might be a risk that the flowing of the sealer 54 into the second atmosphere communication channel 47 could clog the gas channel 66 (atmosphere communication hole 25*a*), or could deteriorate the pressure-fluctuation damping effect exhibited by the damper chamber 65 as a result of flowing of the sealer 54 into the damper chamber 65, although such a risk depends on a distance between the opening 47*a* and the gas channel 66. In view of this, as shown in FIGS. 6, 8 and 11, the second atmosphere communication channel 47 has a large cross-section portion 47*b* which is located in vicinity of the opening 47*a* and which has a cross section larger than that of the opening 47*a*. In the present embodiment, the large cross-section portion 47*b* has a rectangular shape in its plan view. A width of the large cross-section portion 47*b* is substantially the same as the width W1 of the recess 53, and is sufficiently larger than the width W2 of the opening 47*a* of the second atmosphere communication channel 47. Thus, a capillary attraction acting at the large cross-section portion 47*b* is smaller than that acting at the opening 47*a*, so that the sealer 54 having flown through the opening 47*a* of the second atmosphere communication channel 47 from the recess 53 is not likely to flow into the large cross-section portion 47*b*. Similarly, as shown in FIG. 8, the third atmosphere communication channel 48 has a large cross-section portion 48*b* that is located in vicinity of its portion at which the third atmosphere communication channel 48 is connected to the second atmosphere communication channel 47. Therefore, the sealer 54 having flown into the third atmosphere communication channel 48 from the second atmosphere communication channel 47 is not likely to flow into the large cross-section portion 48*b*, thereby preventing the sealer 54 from flowing into the dummy chamber 67. It is noted that the first atmosphere communication channel 46 does not have such a large cross-section portion, because the function of the manifold chamber 5 is not affected even if the sealer 54 is caused to flow into the manifold chamber 5.

Figure 12A:
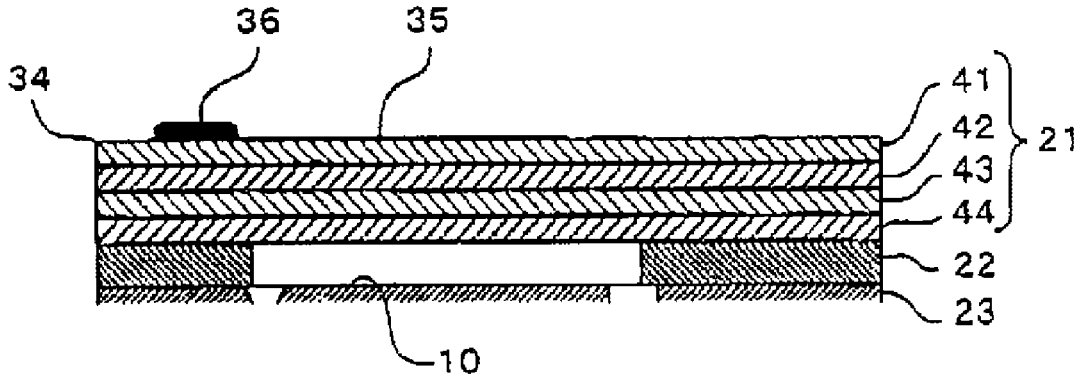
FIG. 12A is a cross sectional view showing a part of an actuator unit that is disposed on the ink channel unit.
Figure 12B:
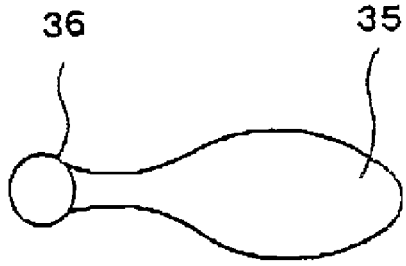
FIG. 12B is a plan view of an individual electrode and a land.

Referring next to FIGS. 12A and 12B, there will be described a construction of each of the actuator units 21 in detail. Each actuator unit 21 includes: the four piezoelectric sheets 41-44 extending to straddle the plurality of pressure chambers 10; the plurality of individual electrodes 35 disposed on the uppermost piezoelectric sheet 41 and located in positions opposed to the respective pressure chambers 10; and a common electrode 34 underlying the uppermost piezoelectric sheet 41 such that the piezoelectric sheet 41 is interposed between the individual electrodes 35 and the common electrode 34.

The piezoelectric sheets 41-44 have substantially the same thickness of for example, about 15 μm, and are bonded to the cavity plate 22. Since each of the sheets 41-44 is thus arranged to cover the multiplicity of pressure chambers 10, the individual electrodes 35 can be formed on the piezoelectric sheet 41 with a high density by using a screen printing technique. It is noted that the piezoelectric sheets 41-44 are made of PZT (lead zirconate titanate) based ceramic material having a ferroelectricity.

As shown in FIG. 12B, each of the individual electrodes 35 has, in its plan view, a diamond-like shape which is almost similar to and is slightly smaller than the shape of the corresponding pressure chamber 10. The individual electrodes 35 are arranged on the upper surface of the uppermost piezoelectric sheet 41 in a matrix as the pressure chambers 10, such that each of the individual electrodes 35 is formed on a portion of the upper surface of the uppermost piezoelectric sheet 41, which portion is located inside the corresponding pressure chamber 10 as seen in the plan view. Each of the diamond-like shaped individual electrodes 35 has a land portion 36 located in one of its opposite acute-angle portions, such that the land portions 36 of the respective individual electrodes 35 extend in the same direction Each of the land portions 36 of the respective individual electrodes 35 has a circular shape having a diameter of about 160 μm, and is formed of gold containing a glass frit. The land portions 36 are held in electrical contact with contact points of the FPC 50 (see FIGS. 1 and 2), such that a drive signal can be inputted from the driver IC 80 (see FIGS. 1 and 2) into the individual electrodes 35 through the land portions 36, for enabling the volumes of the pressure chambers 10 to be changed.

The common electrode 34 having a thickness of about 160 μm is formed between the uppermost piezoelectric sheet 41 and the second uppermost piezoelectric sheet 42, such that each of the mutually opposed surfaces of the sheets 41, 42 is entirely covered by the common electrode 34. The common electrode 34 is grounded in a region that is not shown in the figures, so that all of its portions opposed to the respective pressure chambers 10 are equally given an electric potential of ground level. It is noted that the common electrode 34 as well as the individual electrodes 35 is formed of Ag—Pd based metallic material, for example.

Next, there will be next described an arrangement for driving the actuator unit 21. In the present embodiment, the piezoelectric sheet 41 of the actuator unit 21 is arranged to be polarized in its thickness direction. That is, the actuator unit 21 is of a so-called unimorph type in which the uppermost piezoelectric sheet 41 (which is most distant from the pressure chambers 10) serves as an active layer including active portions while the other three piezoelectric sheets 42-43 (which are close to the pressure chambers 10) serve as inactive layers. In this arrangement, when a predetermined positive or negative voltage is applied between a selected individual electrode or electrodes 35 and the common electrode 34 as an ground electrode such that directions of the electric field and the polarization coincide with each other, a portion or portions of the piezoelectric sheet 41 interposed between the selected individual electrode or electrodes 35 and the common electrode 34 function as the active portions, so as to contract in a direction perpendicular to the polarization direction, owing to a transverse piezoelectric effect.

On the other hand, the piezoelectric sheets 42-44, which are not influenced by the electric field, do not deform themselves. Consequently, there is caused a difference between the uppermost piezoelectric sheet 41 and the other piezoelectric sheets 42-44, with respect to an amount of distortion or deformation in the direction perpendicular to the polarization direction, thereby causing a unimorph deformation, namely, causing the piezoelectric sheets 41-44 as a whole to be convexed downwardly, i.e., in a direction away from the uppermost piezoelectric sheet 41 as the active layer toward the other piezoelectric sheets 42-44 as the inactive layers. In this instance, since the actuator unit 21 provided by the piezoelectric sheets 41-44 is fixed at its lower surface to the cavity plate 22 serving as partition walls defining the pressure chambers 10 as shown in FIG. 12A, the piezoelectric sheets 41-44 are consequently deformed to be convexed toward the corresponding pressure chamber 10, thereby reducing the volume of the pressure chamber 10. The reduction in the volume of the pressure chamber 10 leads to increase in the pressure of the ink stored in the pressure chamber 10, causing the ink to be ejected through the corresponding nozzle 8. Thereafter, when the electric potential at the individual electrode 35 is returned to its original value which is the same as that of the common electrode 34, the sheets 41-44 restore their original shapes, so that the volume of the pressure chamber 10 is returned to its original value, whereby the ink is sucked from the corresponding manifold chamber 5.

It is noted that the arrangement for driving the actuator unit 21 may be changed or modified as needed. For example, the electric potential at each individual electrode 35 may be normally set at a value different from the potential at the common electrode 34. In this modified arrangement, the potential at the corresponding individual electrode 35 is once equalized to the potential at the common electrode 34, in response to a signal requesting an ink ejection, and is then returned to the value different from the potential at the common electrode 34 at a predetermined point of time. That is, the piezoelectric sheets 41-44 restore their original shapes in response to the signal requesting the ink ejection, so that the volume of the pressure chamber 10 is increased to be larger than that in the initial state an which the potential at each individual electrode 35 is set at the value different from the potential at the common electrode 34), whereby the ink is sucked to the pressure chamber 10 from the corresponding manifold chamber 5. Then, at the predetermined point of time at which the potential at the individual electrode 35 is returned to the value different from the potential at the common electrode 34, the piezoelectric sheets 41-44 are deformed to be convexed toward the pressure chamber 10, whereby the ink is ejected as a result of increase in the pressure of the ink which is caused by reduction in the volume of the pressure chamber 10.

Figure 13:
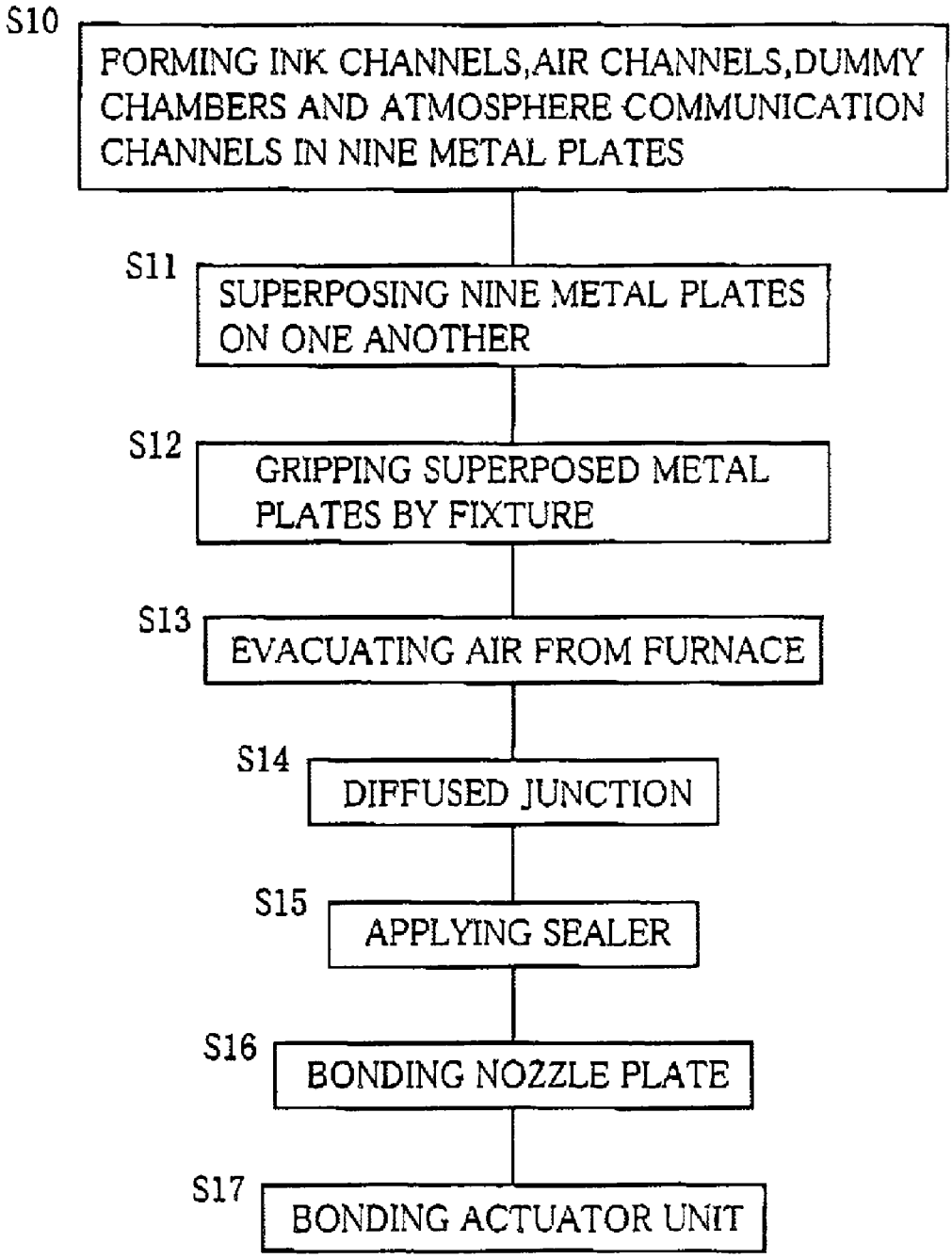
FIG. 13 is a flow chart showing steps of a process of manufacturing the inkjet head.

Next, there will be next described a process of manufacturing the inkjet head 1, with reference to FIG. 13 that is a flow chart showing steps of the manufacturing process. In FIG. 13, reference sings Si (i=10, 11, . . . ) denote the respective steps.

The manufacturing process is initiated with step S10 of forming, in the nine metal plates 22-30 of the metal plates 22-31 constituting the ink channel unit 4, the networks of the ink channels 32 (which provide the pressure chambers 10, manifold chambers 5 and sub manifold chambers 5*a*), the networks of the gas channels 66 (which provide the damper chambers 65) (see FIG. 6), and the dummy chambers 67 (compliance adjusting spaces) (see FIGS. 5B and 9), by means of etching or the like. In this step S10, the first atmosphere communication channels 46 diverging from the ink channels 32, the second atmosphere communication channels 47 diverging from the gas channels 66, and the third atmosphere communication channels 48 held in communication with the dummy chambers 67 and connected to the second atmosphere communication channels 47 are concurrently formed, too. In the present embodiment, the apertures 12 of the aperture plate 24, the damper chambers 65, and the atmosphere communication channels 46, 47, 48 are formed by half-etching. Further, in the step S10, the cutouts 50, 51, 52 are formed, too, as shown in FIG. 11A. The cutouts 50 are formed in the manifold plate 27, so as to be held in communication with the openings 46*a* of the respective fist atmosphere communication channels 46. The cutouts 51 are formed in the supply plate 25, so as to be held in communication with the openings 47*a* of the respective second atmosphere communication channels 47. The cutouts 52 are formed in the manifold plate 26, such that each of the cutouts 52 can be brought into communication with the corresponding cutout 50 and the corresponding cutout 51 when the plates 25, 26, 27 are superposed on another In the present embodiment, each of the atmosphere communication channels 46, 47, 48 is provided by a groove or recess that is formed by half-etching, as is clear form the foregoing description. However, each of the atmosphere communication channels 46, 47, 48 may be provided by a slot or slit formed through a corresponding one of the metal plates.

The step S10 is followed by step S11 of superposing the nine plates 22-30 on one another, as shown in FIG. 14. In this instance, as shown in FIG. 11, the nine plates 22-30 are positioned relative to one another such that the cutouts 50, 51, 52 formed in the respective three plates 27, 25, 26 are held in communication with-one another. The step S11 is followed by step S12 in which the nine plates 22-30 superposed on one another are gripped or pressed between a pair of jig members 60, 61 having respective flat contact surfaces 60*a*, 61*a* such that the flat contact surfaces 60*a*, 61*a* of the respective jig members 60 are respectively held in contact with opposite end ones (plates 22, 30) of the superposed nine plates 22-30. This step S12 is implemented within a heating furnace for diffusion welding. In this instance, the ink channels 32 (providing the pressure chambers 10, manifold chambers 5 and sub manifold chambers 5*a*) and the gas channels 66 (providing the damper chambers 65) are closed at their openings opening in the plates 22, 30 by the pair of jig members 60, 61. However, the ink channels 32 and the gas channels 66 are held in communication with the atmosphere via the first and second atmosphere communication channels 46, 47 Further, the dummy chambers 67 formed in the manifold plate 26 are held in communication with the atmosphere via the third atmosphere communication channels 48.

With the above state being maintained, step S13 is implemented to evacuate the air from the heating furnace, by using a vacuum pump, so that the air is discharged from the ink channels 32, gas channels 68 and damper chambers 67. Step S14 is then implemented to fix the nine metal plates 22-30 to one another by the diffusion welding in the heating furnace, namely, by heating the plates 22-30 to a high temperature (e.g., about 1000° C.) while the plates 22-30 are forced onto one another by the jig members 60, 61. Thus, since the diffusion welding is carried out after the air has been completely discharged from cavities formed in the superposed plates 22-30, it is possible to prevent deformation of the metal plates 22-30 due to expansion and contraction of the air, and also to prevent failure of fixation of the metal plates 22-30 due to considerable increase in the air pressure. The thus obtained laminated structure body 68 is taken out from the heating furnace, after it has been spontaneously cooled to a predetermined temperature.

Step S14 is followed by step S15 in which each of the recesses 53 is filled or charged with the sealer 54, as shown in FIG. 11B, so as to simultaneously seal the openings 46*a*, 47*a* of the first and second atmosphere communication channels 46, 47 that are held in communication with the recess 53. Then, in step S16, the nozzle plate 31 is fixed to the cover plate 30 by an adhesive, whereby preparation of the ink channel unit 4 is completed. Finally, step S17 is implemented to the actuator unit 21 is fixed to the ink channel unit 4 (cavity plate 22) by an adhesive.

The above-described inkjet head 1 and the process of manufacturing the same provide the following technical effects.

In the nine 22-30 of the metal plates superposed on one another to constitute the ink channel unit 4, there are formed the first atmosphere communication channels 46 which diverge from the ink channels 32 (providing the pressure chambers 10, manifold chambers 5 and sub manifold chambers 5*a*) and which open to the atmosphere, the second atmosphere communication channels 47 which diverge from the gas channels 66 (providing the damper chambers 65) and which open to the atmosphere, and the third atmosphere communication channels 48 which bring the dummy chambers 67 into communication with the atmosphere. Owing to the presence of the atmosphere communication channels 46, 47, 48, the air contained in the ink channels 32, gas channels 66 and dummy chambers 67 can be reliably evacuated via the atmosphere communication channels 46, 47, 48, prior to the diffusion welding of the nine metal plates 22-30, thereby making it possible to prevent deformation of the metal plates due to expansion and contraction of the air, and also to prevent failure of fixation of the metal plates 22-30 due to considerable increase in the air pressure.

Further, since the openings 46*a* of the first atmosphere communication channels 46 are sealed after the above-described diffusion welding has been completed, the ink does not leak outside the ink channel unit 4 through the first atmosphere communication channels 46 after the ink channels 32 are filled with the ink. Further, since the openings 47*a* of the second atmosphere communication channels 47 are also sealed, it is possible to avoid the ink from flowing into the damper chambers 65 and accordingly prevent deterioration of the function of the damper chambers 65 for damping the pressure fluctuation. Still further, since the third atmosphere communication channels 48 connected to the second atmosphere communication channels 47 are also sealed concurrently with the first and second atmosphere communication channels 46, 47, the ink does not flow into the dummy chambers 67.

Each of the first atmosphere communication channels 46 and a corresponding one of the second atmosphere communication channels 47 extend to the same side surface of the laminated structure body 68 that is provided by the nine metal plates 22-30. Further, the openings 46*a* of each of the first atmosphere communication channels 46 and the opening 47*a* of a corresponding one of the second atmosphere communication channels 47 are held in communication with a corresponding one of the recesses 53 that is formed in the above-described same side surface of the laminated structure body 68. This arrangement enables the first and second atmosphere communication channels 46, 47 to be concurrently sealed by disposing the sealer 54 in the recess 53, thereby facilitating a sealing operation. Moreover, since each of the third atmosphere communication channels 48 is connected to a corresponding one of the second communication channels 47, each of the third atmosphere communication channels 48 also can be sealed concurrently with the corresponding first and second atmosphere communication channels 46, 47, thereby further facilitating the sealing operation. In addition, since the cross sectional area of each of the recesses 53 is sufficiently larger than that of each of the openings 46*a*, 47*a*, the sealer 54 can be easily disposed within each recess 53. It is therefore possible to avoid the sealer 54 from flowing out from the recess 53 and reaching surfaces of the nozzle plate 31 and the actuator unit 21, and to prevent deterioration of functions of the nozzles 8 and the actuator unit 21.

While the presently preferred embodiment of the present invention has been described above in detail, it is to be understood that the invention is not limited to the details of the illustrated embodiment, but may be otherwise embodied.

Figure 15:
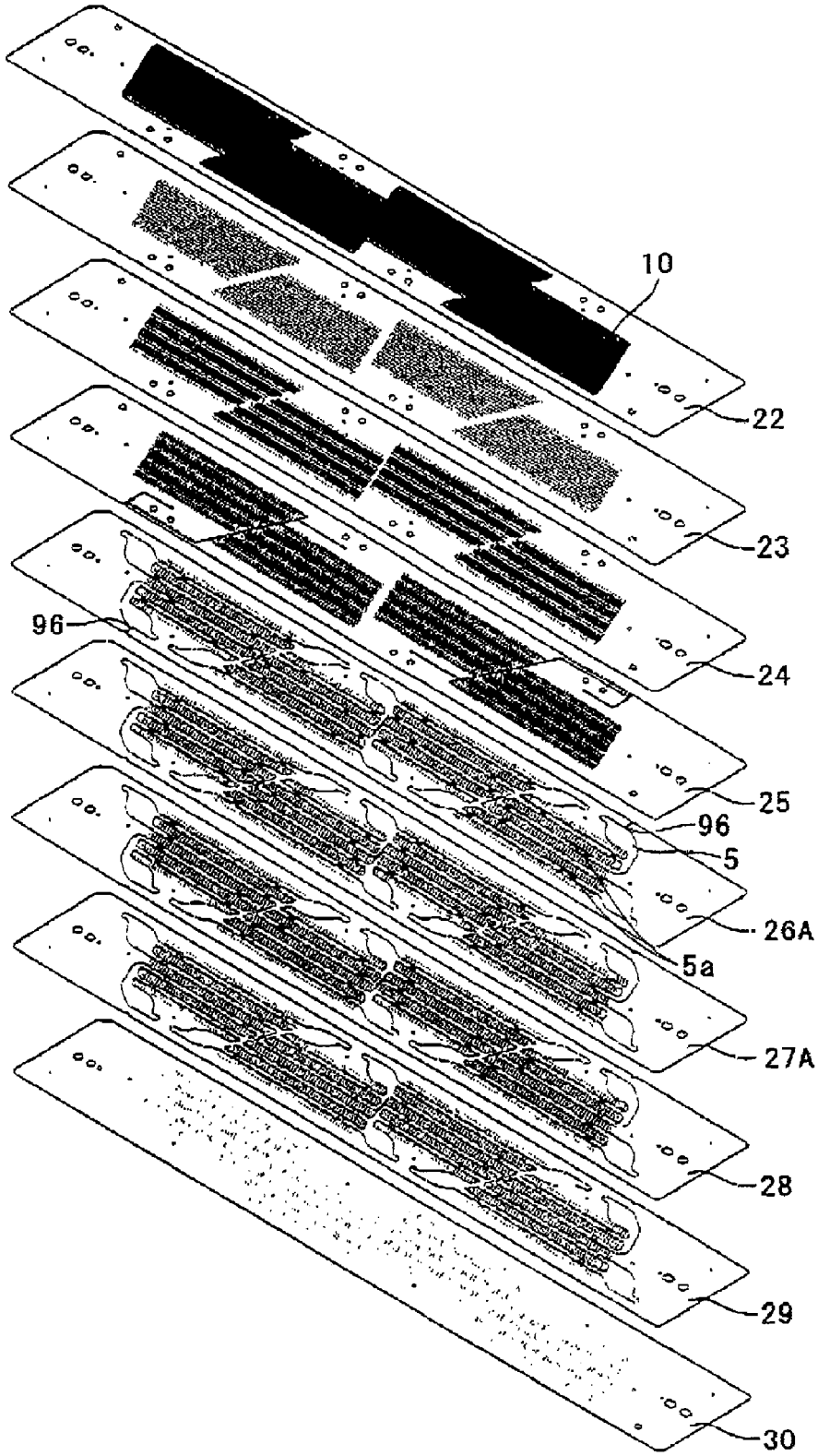
FIG. 15 is a perspective and exploded view of metal plates (not including a nozzle plate) that are superposed on each other to constitute an ink channel unit of the inkjet head, which is constructed according to a modification of the embodiment.
Figure 16:
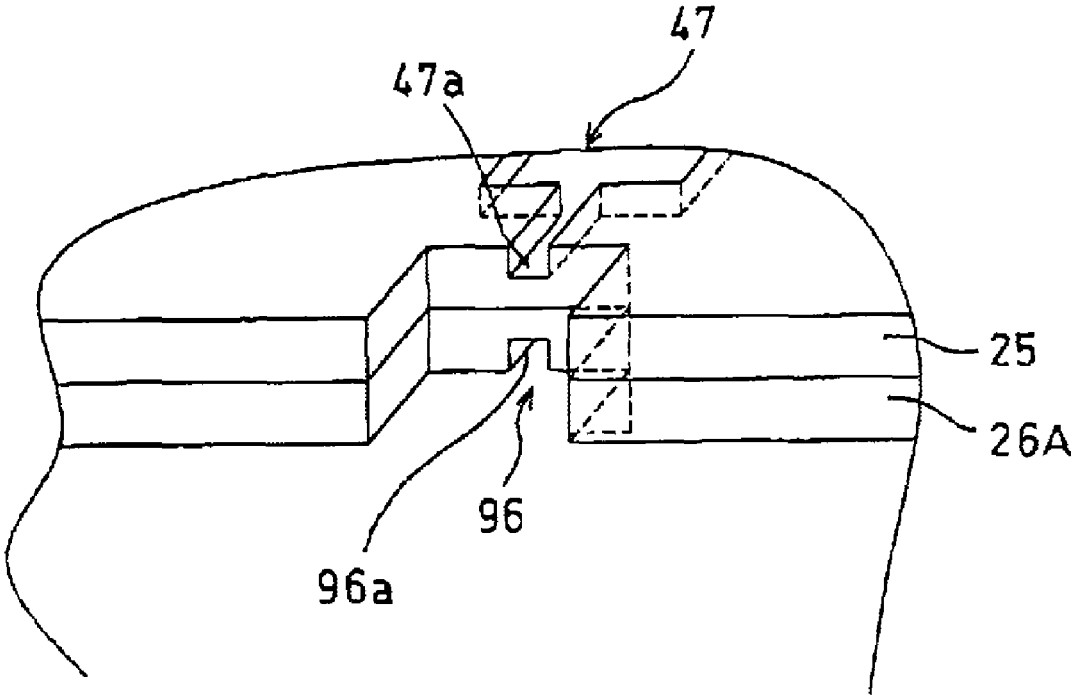
FIG. 16 is an enlarged perspective view showing two of metal plates (constituting the ink channel constructed according to the modification of the embodiment) in which a recess is formed.

For example, routes of the first, second and third atmosphere communication channels are not limited to the details as described above, but may be modified as needed. FIGS. 15 and 16 show a modified arrangement in which first atmosphere communication channels 96 are formed in an uppermost one 26A of four manifold plates 26A, 27A, 28, 29 (common-ink-chamber defining plates) that cooperate to define the manifold chambers 5 and sub manifold chambers 5*a* (common ink chambers). In this modified arrangement, each of the first atmosphere communication channels 96 diverges from a corresponding one of the manifold chambers 5 and extends to a cutout 53A formed in the manifold plate 26A that is most distant (among the four manifold plates 26A, 27A, 28, 29) from the nozzle plate 310 This modified arrangement enables the openings 96*a* of the first atmosphere communication channels 96 to be positioned to be further distant from the nozzles 8 of the nozzle plate 31, thereby making it possible to further reliably avoid the sealer from adhering to a lower surface (nozzle opening surface) of the nozzle plate 31 when the first atmosphere communication channels 96 are sealed at their openings 96*a* by the sealer. Further, each of the first atmosphere communication channels may diverge from a portion of the corresponding network of the ink channels 32, which is other than the manifold chamber 5.

In the above-described embodiment, the nine metal plates 22-30 are all at once fixed by the diffusion welding. However, the present invention is equally applicable to another arrangement, as long as at least the manifold chambers 5 and sub manifold chambers 5*a* (common ink chambers) are formed in a plurality of metal plates fixed to each other by means of, for example, the diffusion welding. In such an arrangement, too, the air contained in the common ink chambers each having a large volume can be reliably evacuated. That is, where at least one enclosed space is present within the laminated structure body at least when the metal plates are fixed to each other to provide the laminated structure body, the application of the present invention enables the laminated structure body to be established without failure of fixation of the metal plates, irrespective of the volume of the at least one enclosed space. Further, while the nine metal plates 22-30 are fixed by the diffusion welding in the above-described embodiment, the ten metal plates 22-31 including the nozzle plate 31 may be concurrently fixed to one another by the diffusion welding.

In the above-described embodiment, the dummy chambers 67 are provided only in the respective regions opposed to the pressure chambers 10 of the columns 11*c*, 11*d* having the relatively small compliance (see FIGS. 4 and 9). However, where there is a difference even among the pressure chambers 10 belonging to the same column 11, with respect to area opposed to the sub manifold chamber 5*a*, each of the dummy chambers 67 may be formed to have a volume corresponding to the area of the corresponding pressure chamber 10, which area is opposed to the sub manifold chamber 5*a*. In such a case, for example, each dummy chamber 67 corresponding to the pressure chamber 10 having a relatively large area opposed to the sub manifold chamber 5*a* may be formed to have a relatively small volume, while each dummy chamber 67 corresponding to the pressure chamber 10 having a relatively small area opposed to the sub manifold chamber 5*a* may be formed to have a relatively large volume.

What is claimed is:

1. An inkjet head comprising:

an ink channel unit defining a network of ink channels which provides at least one common ink chamber and a plurality of nozzles held in communication with said at least one common ink chamber, wherein said ink channel unit includes a laminated structure body that is provided by a plurality of metal plates superposed on each other, wherein said laminated structure body has at least said at least one common ink chamber and an atmosphere communication channel which diverges from said network of ink channels and which is held in communication with said network of ink channels, wherein said atmosphere communication channel extends toward an exterior of said laminated structure body, so as to open outside said laminated structure body, wherein said atmosphere communication channel is sealed at an opening thereof, and wherein said ink channel unit further includes a sealer by which said atmosphere communication channel is sealed at said opening thereof.

2. The inkjet head according to claim 1, wherein said sealer is formed of a resin.

3. The inkjet head according to claim 1, wherein said atmosphere communication channel diverges from one of said at least one common ink chamber of said network of ink channels.

4. The inkjet head according to claim 1, wherein said ink channel unit further defines a network of gas channels which provides at least one damper chamber each opposed to a corresponding one of said at least one common ink chamber, wherein said laminated structure body has, in addition to said at least one common ink chamber and said atmosphere communication channel as a first atmosphere communication channel, said at least one damper chamber and a second atmosphere communication channel that diverges from said network of gas channels, wherein said second atmosphere communication channel extends toward the exterior of said laminated structure body, so as to open outside said laminated structure body, and wherein said second atmosphere communication channel is sealed at an opening thereof.

5. The inkjet head according to claim 4, wherein said opening of said first atmosphere communication channel and said opening of said second atmosphere communication channel both open in a same surface of said laminated structure body, and wherein said same surface of said laminated structure body is substantially parallel to a superposed direction in which said plurality of metal plates are superposed on each other.

6. The inkjet head according to claim 5, wherein said ink channel unit further includes a nozzle plate which has said plurality of nozzles formed therein and which is attached to said laminated structure body, wherein each of said gas channels opens outside said laminated structure body, at an opening thereof located in one of said plurality of metal plates that is most distant from said nozzle plate, and wherein said second atmosphere communication channel diverges from one of said gas channels, and extends to said same surface of said laminated structure body.

7. The inkjet head according to claim 6, wherein said plurality of metal plates providing said laminated structure body include at least two common-ink-chamber defining plates which cooperate with each other to define said at least one common ink chamber, wherein said first atmosphere communication channel diverges in one of said at least two common-ink-chamber defining plates, from one of said at least one common ink chamber, and has the sealed opening located in said one of said at least two common-ink-chamber defining plates, and wherein said one of said at least two common-ink-chamber defining plates is most distant from said nozzle plate among said at least two common-ink-chamber defining plates.

8. The inkjet head according to claim 4, wherein said network of ink channels defined by said ink channel unit further provides a plurality of pressure chambers which lie on a plane and which are held in communication with said plurality of nozzles and said at least one common ink chamber, wherein some of said plurality of pressure chambers at least partially overlap with said at least one common ink chamber as viewed in a superposed direction in which said plurality of metal plates of said laminated structure body are superposed on each other, wherein said laminated structure body further has a third atmosphere communication channel and at least one dummy chamber which is isolated from said network of ink channels and which is held in communication with said third atmosphere communication channel, and wherein said at least one dummy chamber overlaps with a part of some of said plurality of pressure chambers in said superposed direction, which part does not overlap with said at least one common ink chamber in said superposed direction.

9. The inkjet head according to claim 8, wherein said third atmosphere communication channel and said second atmosphere communication channel are connected to each other within said laminated structure body.

10. The inkjet head according to claim 1, wherein said atmosphere communication channel is held in communication with said at least one common ink chamber of said network of ink channels.

11. The inkjet head according to claim 1, wherein said opening of said atmosphere communication channel opens in a side surface of each of at least one of said plurality of metal plates, and wherein said side surface is substantially parallel to a superposed direction in which said plurality of metal plates are superposed on each other.

12. An inkjet head comprising:

an ink channel unit defining a network of ink channels which provides at least one common ink chamber and a plurality of nozzles held in communication with said at least one common ink chamber, wherein said ink channel unit includes a laminated structure body that is provided by a plurality of metal plates superposed on each other, wherein said laminated structure body has at least said at least one common ink chamber and an atmosphere communication channel which diverges from said network of ink channels, wherein said atmosphere communication channel extends toward an exterior of said laminated structure body, so as to open outside said laminated structure body, wherein said atmosphere communication channel is sealed at an opening thereof, wherein said ink channel unit further includes a sealer by which said atmosphere communication channel is sealed at said opening thereof, wherein said ink channel unit further defines a network of gas channels which provides at least one damper chamber each opposed to a corresponding one of said at least one common ink chamber, wherein said laminated structure body has, in addition to said at least one common ink chamber and said atmosphere communication channel as a first atmosphere communication channel, said at least one damper chamber and a second atmosphere communication channel that diverges from said network of gas channels, wherein said second atmosphere communication channel extends toward the exterior of said laminated structure body, so as to open outside said laminated structure body, wherein said second atmosphere communication channel is sealed at an opening thereof, wherein said opening of said first atmosphere communication channel and said opening of said second atmosphere communication channel both open in a same surface of said laminated structure body, wherein said same surface of said laminated structure body is substantially parallel to a superposed direction in which said plurality of metal plates are superposed on each other, and wherein said laminated structure body has a recess formed in said same surface thereof, such that said opening of said first atmosphere communication channel and said opening of said second atmosphere communication channel are both located in said recess.

13. The inkjet head according to claim 12, wherein said plurality of metal plates providing said laminated structure body include at least two plates contiguous to each other and having respective cutouts which cooperate with each other to provide said recess, and wherein said cutouts are provided by at least first and second cutouts in which said opening of said first atmosphere communication channel and said opening of said second atmosphere communication channel are respectively located.

14. The inkjet head according to claim 12, wherein said recess has a cross section larger than that of said opening of said first atmosphere communication channel and that of said opening of said second atmosphere communication channel.

15. An inkjet head comprising:

an ink channel unit defining a network of ink channels which provides at least one common ink chamber and a plurality of nozzles held in communication with said at least one common ink chamber, wherein said ink channel unit includes a laminated structure body that is provided by a plurality of metal plates superposed on each other, wherein said laminated structure body has at least said at least one common ink chamber and an atmosphere communication channel which diverges from said network of ink channels, wherein said atmosphere communication channel extends toward an exterior of said laminated structure body, so as to open outside said laminated structure body, wherein said atmosphere communication channel is sealed at an opening thereof, wherein said ink channel unit further includes a sealer by which said atmosphere communication channel is sealed at said opening thereof, wherein said ink channel unit further defines a network of gas channels which provides at least one damper chamber each opposed to a corresponding one of said at least one common ink chamber, wherein said laminated structure body has, in addition to said at least one common ink chamber and said atmosphere communication channel as a first atmosphere communication channel, said at least one damper chamber and a second atmosphere communication channel that diverges from said network of gas channels, wherein said second atmosphere communication channel extends toward the exterior of said laminated structure body, so as to open outside said laminated structure body, wherein said second atmosphere communication channel is sealed at an opening thereof, and wherein said second atmosphere communication channel has a large cross-section portion whose cross section is larger than that of said opening of said second atmosphere communication channel.

* * * * *